US011780665B2

(12) United States Patent
Silver

(10) Patent No.: US 11,780,665 B2
(45) Date of Patent: Oct. 10, 2023

(54) DISPENSING DEVICES, SYSTEMS, AND METHODS

(71) Applicant: SMART CAP LICENSING PTY LTD, Sydney (AU)

(72) Inventor: Benjamin Silver, Sydney (AU)

(73) Assignee: SMART CAP LICENSING PTY LTD, Sydney (AU)

( * ) Notice: Subject to any disclaimer, the term of this patent is extended or adjusted under 35 U.S.C. 154(b) by 0 days.

(21) Appl. No.: 17/378,222

(22) Filed: Jul. 16, 2021

(65) Prior Publication Data

US 2022/0024673 A1 Jan. 27, 2022

(30) Foreign Application Priority Data

Jul. 22, 2020 (AU) ..... 2020902547

(51) Int. Cl.
*B65D 81/32* (2006.01)
*B65D 51/28* (2006.01)

(52) U.S. Cl.
CPC ..... *B65D 81/3222* (2013.01); *B65D 51/2842* (2013.01)

(58) Field of Classification Search
CPC ..... B65D 81/3222; B65D 51/2842
See application file for complete search history.

(56) References Cited

U.S. PATENT DOCUMENTS

D57,588 S 4/1921 Crawford
3,802,604 A * 4/1974 Morane ..... B65D 51/28 222/85
3,924,741 A * 12/1975 Kachur ..... B65D 51/2892 604/416
4,132,308 A * 1/1979 Goncalves ..... B65D 51/2842 215/DIG. 8

(Continued)

FOREIGN PATENT DOCUMENTS

CN 2322918 Y 6/1999
CN 110342097 A 10/2019

(Continued)

OTHER PUBLICATIONS

"International Search Report and Written Opinion of the International Searching Authority," issued in connection with Int'l Appl. No. PCT/AU2021/050765 dated Nov. 3, 2021 (10 pages).

*Primary Examiner* — Frederick C Nicolas
(74) *Attorney, Agent, or Firm* — Holland & Hart LLP

(57) ABSTRACT

The disclosed technology includes dispensing systems, devices, and methods. The dispensing systems include a plurality of sealing components, and a plurality of coupling mechanisms. In one embodiment, a dispensing device, including a first unit having a top wall and an inner cylindrical projection extending from a bottom face of the top wall and a second unit having an outer cylinder, is adapted to be received by a receptacle. The inner cylinder receives the inner cylindrical projection and the outer cylinder receives the receptacle. A breakable seal closes an opening (Continued)

of the inner cylinder to form a chamber portion for storing a substance. Protruding seals on the inner cylindrical projection bear on the inner cylinder. An application of force to the top wall lowers the inner cylindrical projection to disrupt the breakable seal and release the substance into the receptacle to mix with a liquid stored in the receptacle.

26 Claims, 15 Drawing Sheets

(56) References Cited

U.S. PATENT DOCUMENTS 4,591,050 A * 5/1986 Finke ..... B65D 51/28 215/DIG. 8
4,903,865 A * 2/1990 Janowitz ..... B65D 51/2842 604/416
4,982,875 A * 1/1991 Pozzi ..... B65D 81/3222 604/416
5,038,951 A * 8/1991 Rizzardi ..... B65D 51/285 215/256
D347,571 S 6/1994 Wacker
D364,801 S 12/1995 Kuhn
5,474,209 A * 12/1995 Vallet Mas ..... B65D 51/285 215/DIG. 8
5,496,011 A * 3/1996 Samargo ..... B65D 47/243 251/246
5,499,985 A * 3/1996 Hein ..... A61B 17/162 606/1
5,543,097 A * 8/1996 Fang ..... G01N 27/44704 264/102
5,649,648 A * 7/1997 Lier ..... B65D 1/32 222/206
5,782,345 A * 7/1998 Guasch ..... B65D 51/285 206/219
D399,420 S 10/1998 Holliday et al.
5,938,087 A * 8/1999 Randall ..... B65D 47/0838 222/571
D437,556 S 2/2001 Holliday et al.
6,921,087 B2 * 7/2005 Takahashi ..... B65D 51/2878 206/219
7,025,200 B2 * 4/2006 Fontana ..... B65D 51/285 206/222
7,028,869 B2 * 4/2006 De Laforcade .... B65D 81/3211 222/129
7,249,690 B2 * 7/2007 Smith ..... B65D 51/2835 222/153.05
7,331,491 B2 * 2/2008 King ..... B65D 47/242 222/521
7,506,782 B2 * 3/2009 Walters ..... B65D 51/2835 222/145.5
7,870,952 B2 * 1/2011 Fontana ..... B65D 51/2892 206/219
7,951,109 B2 * 5/2011 Anderson ..... A61J 1/2096 604/416
8,016,159 B2 * 9/2011 Ma ..... B65D 41/3447 426/112
8,100,303 B2 * 1/2012 Parve ..... B65D 47/0857 220/254.2
D693,688 S 11/2013 Russell et al.
8,608,001 B2 * 12/2013 Stoneberg ..... B65D 47/0819 220/837
8,631,938 B2 * 1/2014 Roland ..... B65D 75/5855 206/484
8,640,865 B2 * 2/2014 Smart ..... B65D 51/2835 222/129
8,701,906 B1 * 4/2014 Anderson ..... B65D 41/20 215/DIG. 8
8,844,715 B2 * 9/2014 Lee ..... B65D 51/2864 222/129
D786,679 S 5/2017 Barroso et al.
D823,689 S 7/2018 Durand
D826,055 S 8/2018 Augustyniak et al.
D826,057 S 8/2018 Joao Do Silva Antunes Da Guia
D849,543 S 5/2019 Augustyniak et al.
D867,069 S 11/2019 Wang
D878,156 S 3/2020 Rittri
D878,868 S 3/2020 Pisarevsky
D917,292 S 4/2021 Blomberg et al.
11,180,296 B2 * 11/2021 Bangera ..... B65D 51/2835
2003/0017236 A1 1/2003 Makita et al.
2004/0161504 A1 * 8/2004 Daniels ..... C02F 1/68 426/115
2009/0152267 A1 * 6/2009 May ..... A61J 1/2089 222/145.5
2009/0152296 A1 * 6/2009 May ..... B05C 17/00559 222/145.5
2015/0203275 A1 * 7/2015 May ..... B65D 81/3272 206/219

FOREIGN PATENT DOCUMENTS

CN 210000860 U 1/2020
JP 2006-124002 A 5/2006
WO 2015/024359 A1 2/2015

* cited by examiner

DISPENSING DEVICES, SYSTEMS, AND METHODS

CROSS REFERENCE TO RELATED APPLICATION

This application claims priority to and the benefit of Australian Provisional Patent Application No. 2020902547, filed Jul. 22, 2020, entitled "A DISPENSING DEVICE," the disclosure of which is incorporated herein by reference in its entirety.

FIELD OF DISCLOSURE

The present disclosure relates to dispensing devices, systems, and methods for dispensing and storing a flowable substance.

BACKGROUND OF DISCLOSURE

Any discussion of the prior art throughout the specification should in no way be considered as an admission that such prior art is widely known or forms part of common general knowledge in the field.

Drink mixes are added to hot or cold liquids to create flavoured beverages. Often, drink mixes are in liquid form, such as cordial, syrup, creamer, etc., or in powdered form such as powdered drink mix, instant coffee, TANG, KOOL-AID, hot chocolate, BEROCCA, medicinal powders, etc. While powdered drink mixes have typically been considered to be unhealthy, there has been some development in healthy vitamin-rich powdered drink mixes such as those that use vegetable and fruit powders.

To create a flavoured beverage, a recommended amount of drink mix is measured and dissolved with a recommended amount of liquid. This process is quite messy and time consuming for the user, and unfortunately, it is difficult to consistently measure and dose the recommended amount of drink mix, resulting in an inconsistent flavour profile between drinks. It would be advantageous if the drink mix was premeasured to ensure consistency.

Powdered and liquid drink mixes are stored separately to the liquid they are dissolved in. As such, drink mix beverages are difficult to transport unless they are pre-mixed, which can lead to an undesirable flavour profile and reduced freshness. Alternatively, a consumer may pack their drink mix and liquid separately, however this is inconvenient, and increases the number of items a consumer must carry. It would be advantageous if there were provided a convenient way to transport a drink mix and liquid together.

Preferably, drink mixes are stored in air-tight receptacles before being mixed with a liquid to ensure they maintain their freshness and potency. Unfortunately, it is not uncommon for the seal of most containers to be compromised, resulting in decreased freshness and potential spoilage of the drink mix before consumption.

Powdered drink mixes are generally not mixed with liquid until they are consumed. This can be due to a number of reasons. For example, powdered products with therapeutic benefits such as antibiotics, vitamins and minerals may be unstable or may lose their potency the longer they are exposed to a liquid. Further, based on the consistency and ingredients of the powdered drink mix, there is a likelihood that the powder will, over time, separate from the liquid creating small solid formations and an undesirable flavour profile. In the event that the powdered drink mix comprises components with nutrient value such as vegetable or fruit powder, there is an increased risk of spoilage if the powder is not sealed correctly before being mixed with the liquid. This is similarly the case for certain liquid drink mixes.

SUMMARY OF DISCLOSURE

In accordance with a first aspect of the present disclosure there is provided a dispensing system, including a dispensing device adapted to be received by a receptacle, the dispensing device includes a first unit having a top wall and an inner cylindrical projection extending from a bottom face of the top wall, a second unit having an outer cylinder and an inner cylinder joined by a bridging portion, wherein the inner cylinder is adapted to receive the inner cylindrical projection, and the outer cylinder is adapted to receive the receptacle, a breakable seal closing an opening of the inner cylinder to form a chamber portion for storing a flowable substance, and one or more protruding seals located on the inner cylindrical projection adapted to bear on a portion of the inner cylinder, wherein an application of force to the top wall lowers the inner cylindrical projection to disrupt the breakable seal and release the flowable substance.

In an embodiment, a first coupling mechanism couples the first and second unit, the first coupling mechanism includes an outer cylindrical projection extending from the bottom face of the first unit having a raised collar portion, and a collar receiving portion located on the outer cylinder of the second unit adapted to receive the raised collar portion.

In a further embodiment, a second coupling mechanism couples the first and second unit, the second coupling mechanism includes an outer cylindrical projection extending from the bottom face of the first unit having a channel receiving portion with a channel opening adapted to receive a channel located on the outer cylinder of the second unit via the channel opening, wherein the channel bears on a portion of the channel receiving portion. In a further embodiment, a plurality of coupling mechanisms couple the first and second unit, a first coupling mechanism including an outer cylindrical projection extending from the bottom face of the first unit having a raised collar portion and a collar receiving portion located on the outer cylinder of the second unit adapted to receive the raised collar portion, and a second coupling mechanism including a channel receiving portion located on the outer cylinder of the second unit adapted to receive the channel via the channel opening, wherein application of force to the top wall of the first unit urges the raised collar portion out of the collar receiving portion and guides the channel receiving portion along the channel until bearing on a closed end of the channel.

In an embodiment, the one or more protruding seals have a trapezoidal cross section.

In an embodiment, the dispensing device further includes a receptacle seal projecting from the bridging portion adapted to bear on an inner face of the receptacle.

In an embodiment, the bridging portion bears on an upper face of the receptacle and the receptacle seal bears on an inner face of the receptacle perpendicular to the upper face.

In an embodiment, the dispensing device further includes a pair of o-rings on the inner cylindrical projection, or a pair of o-rings may be the seals on the first unit.

In an embodiment, the outer cylinder of the second unit includes a threaded portion adapted to receive a complimentary threaded portion on the receptacle.

In an embodiment, the breakable seal is formed of plastic.

In an embodiment, the breakable seal is integrally joined to the second unit.

In an embodiment, the material of the breakable seal is tapered in thickness from a center of the breakable seal towards a circumference of the breakable seal.

In an embodiment, a portion of the breakable seal remains attached to the inner cylinder when disrupted.

In an embodiment, the one or more protruding seals bear on the inner cylinder such that an oxygen barrier is created at the location of the one or more protruding seals bearing on the inner cylinder.

In an embodiment, the bridging portion bears on an upper face of the receptacle and the receptacle seal bears on an inner face of the receptacle perpendicular to the upper face of the receptacle such that an oxygen barrier is created at the locations of the bridging portion bearing on an upper face of the receptacle and the receptacle seal bearing on an inner face of the receptacle perpendicular to the upper face of the receptacle.

In an embodiment, the flowable substance is a liquid or a solid.

In an embodiment, the flowable substance is a vegetable or fruit powder.

In an embodiment, the receptacle contains a liquid.

In an embodiment, the dispensing device and receptacle are formed of aluminium.

In an embodiment, the inner cylindrical projection includes a terminating end that is sloped from one side of the inner cylindrical projection to the other side of the inner cylindrical projection.

In an embodiment, the inner cylindrical projection includes a portion of a terminating end that is shaped.

In an embodiment, the first unit is formed of polypropylene plastic, the second unit is formed of polypropylene plastic and the breakable seal is formed of low-density polyethylene plastic.

In accordance with an aspect of the disclosure, a dispensing device is adapted to be received by a receptacle, including a first unit having a top wall and an inner cylindrical projection extending from a bottom face of the top wall, a second unit having an outer cylinder and an inner cylinder joined by a bridging portion, wherein the inner cylinder is adapted to receive the inner cylindrical projection, and the outer cylinder is adapted to receive the receptacle; a breakable seal closing an opening of the inner cylinder to form a chamber portion for storing a flowable substance, one or more protruding seals located on the inner cylinder adapted to bear on a portion of the inner cylindrical projection, and wherein an application of force to the top wall lowers the inner cylindrical projection to disrupt the breakable seal and release the flowable substance.

In an embodiment, a method of manufacturing a dispensing device adapted to be received by a receptacle includes, in any order, manufacturing a first unit having a top wall and an inner cylindrical projection extending from a bottom face of the top wall and manufacturing a second unit having an outer cylinder and an inner cylinder joined by a bridging portion, wherein the inner cylinder is adapted to receive the inner cylindrical projection, and the outer cylinder is adapted to receive the receptacle. The method includes manufacturing one or more protruding seals located on the inner cylindrical projection adapted to bear on a portion of the inner cylinder, and manufacturing a breakable seal, which closes an opening of the inner cylinder to form a chamber portion for storing a flowable substance. During use, an application of force to the top wall lowers the inner cylindrical projection to disrupt the breakable seal and release the flowable substance from the chamber portion.

In an embodiment, a method of using a dispensing device adapted to be received by a receptacle includes storing a flowable substance inside a dispensing device, wherein the dispensing device includes a first unit and a second unit and is adapted to be received by a receptacle. The method may further include receiving a raised collar portion located on an outer cylindrical projection of the first unit into a collar receiving portion located on an outer cylinder of the second unit. The method may further includes receiving a channel located on the outer cylinder of the second unit via a channel opening in a channel receiving portion located on the outer cylindrical projection of the first unit and sealing the flowable substance inside the dispensing device with one or more protruding seals located on an inner cylindrical projection of a first unit of the dispensing device adapted to bear on a portion of the inner cylinder of the second unit of the dispensing device. The method includes any or all of the following operations of applying a force to a top wall of the first unit, urging the raised collar portion out of the collar receiving portion located on the outer cylinder of the second unit, guiding the channel along the channel receiving portion until bearing on a closed end of the channel receiving portion, and lowering the inner cylindrical projection of the first unit to disrupt a breakable seal and another operation may release the flowable substance.

Unless otherwise defined, all technical and scientific terms used herein have the same meaning as commonly understood by one of ordinary skill in the art to which this disclosure belongs. Although methods and materials similar or equivalent to those described herein can be used in the practice or testing of the present disclosure, suitable methods and materials are described below. In case of conflict, the patent specification, including definitions, will control. In addition, the materials, methods, and examples are illustrative only and not intended to be limiting.

BRIEF DESCRIPTION OF DRAWINGS

Embodiments of the present disclosure will now be described, by way of example only, with reference to the accompanying drawings, in which.

DETAILED DESCRIPTION

Figure 1:
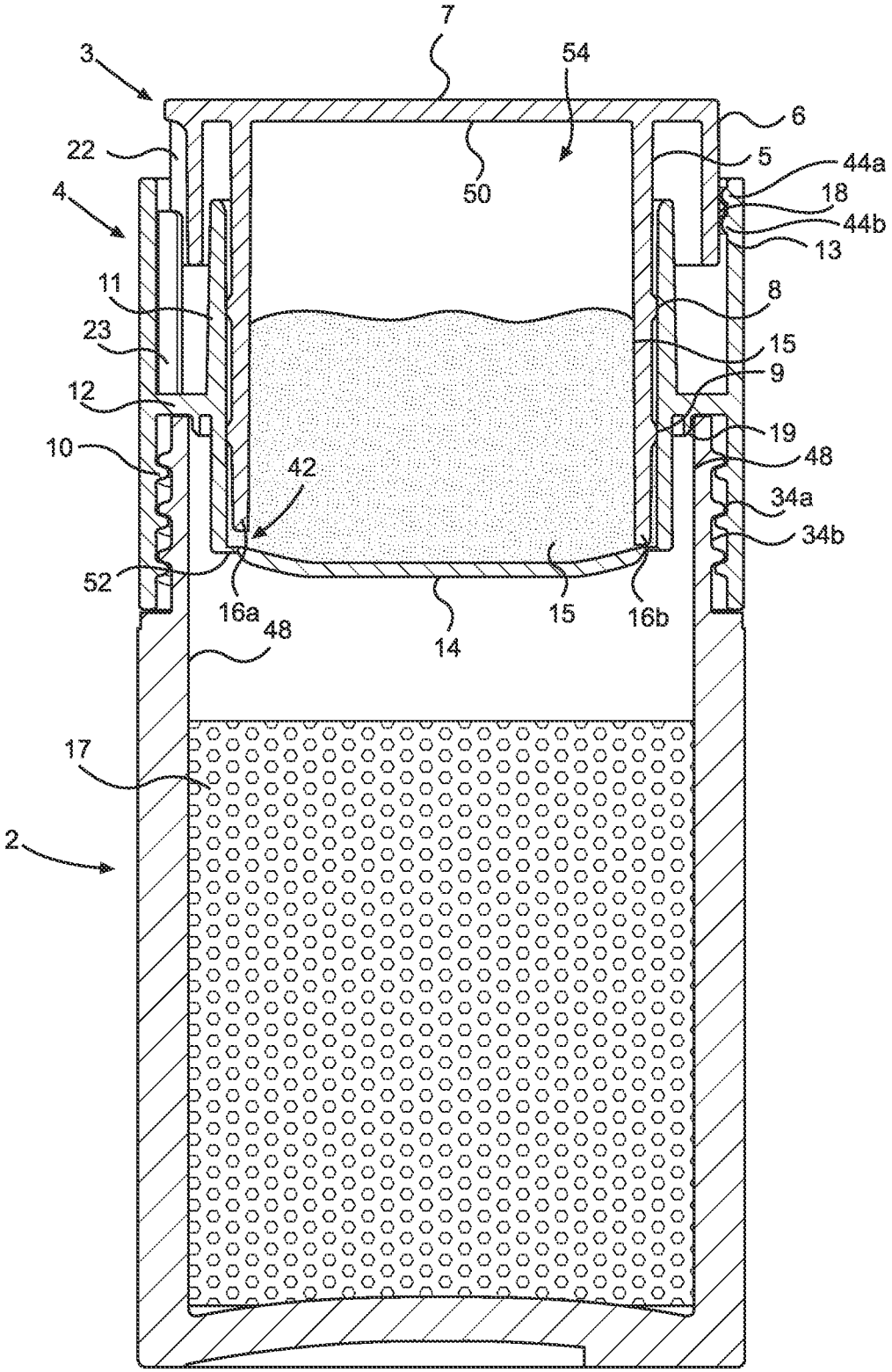
FIG. 1 is a cross-sectional front view of the dispensing device and the receptacle in accordance with aspects of the present disclosure in a first position.

Embodiments of the disclosure described herein relate to dispensing systems, including devices adapted to be received by a receptacle. In some embodiments, the disclosure includes dispensing devices, dispensing devices and receptacles, and methods of making and using the dispensing systems, devices and receptacles. The dispensing device may include a first unit and a second unit and may be utilized by itself or in combination with a receptacle. During a storage phase, the dispensing device and the receptacle are hermetically sealed by one or more sealing components (e.g., a protruding seal, a receptacle seal, interfacing threaded portions) and provide stable storage conditions for products stored within the dispensing device and the receptacle. When a user desires access to the products stored in the dispensing device, a breakable seal located in the second unit of the dispensing device may be disrupted by the first unit thereby releasing the products from the second unit.

The disclosed technology includes dispensing systems and devices that provide airtight containers for storing products (e.g., food supplement powder stored in the dispensing device of the dispensing system and water stored in the receptacle of the dispensing system) for more than 12 months. The disclosed dispensing devices and systems may be used for storing various food, drink, pharmaceutical, or other products. In some embodiments, the disclosed dispensing systems and devices inhibit microbial growth and oxidation of products contained therein without the use of vacuum packaging or addition of chemical preservatives. In some embodiments, the disclosed dispensing systems and devices maintain freshness, improved palatability, and maintain nutritional value of the contents stored therein. In some embodiments, the dispensing device or system provides prolonged shelf life.

Flowable substances that may be stored in the dispensing devices and systems may be any substance that can flow from the dispensing device. For example, solids or liquids. Solids include powders and tablets such as but not limited to; nutrient-based supplements, medicinal supplements, isotonic supplements, powdered drink mixes, instant coffee, tea, TANG, KOOL-AID, hot chocolate, BEROCCA, vegetable powder, fruit powder, vitamins, effervescent tablets, medicines, salt, protein powder, baby formula, etc. Liquids include examples such as, but not limited to, nutrient based supplements, medicinal supplements, isotonic supplements, cordial, syrup, creamer, water, medicines, fruit juice, vegetable juice, flavoured water, etc.

The disclosed dispensing systems may include a dispensing device and a receptacle. The dispensing device may include a first unit and a second unit. The dispensing device and the receptacle may be of any shape, size or colour. In some embodiments, the dispensing device and the receptacle are cylindrical in shape. In some embodiments, the dispensing device and receptacle are a spherocylinder shape which is easy to package and store, has no sharp edges, and is safe for a user to handle. In a further embodiment, the dispensing device and the receptacle are a rectangular shape which may be convenient for storage. A person skilled in the art would appreciate that the ratio of dispensing device to receptacle may vary based on a number of variables such as how much liquid is required. A person skilled in the art would also appreciate that the outer cylinder and inner cylinder may be any shape such that they do not depart from the nature of the disclosure.

The dispensing device and the receptacle may be formed of any material or any combination of materials, such as foil, aluminium, metal, plastic, paper, lined paper etc. In one embodiment, the dispensing device is formed of polypropylene plastic which has a high oxygen barrier. In another embodiment, the dispensing device and receptacle may be formed of the same material allowing them to be easily recycled together. In an embodiment, the first unit and the receptacle are of a material having a greater durometer measurement than the second unit. In one embodiment, the receptacle seal is formed of flexible plastic. In another embodiment, the receptacle seal is formed integrally to the second unit of polypropylene plastic.

In an embodiment, the dispensing device and/or receptacle may be formed of recyclable materials. In some embodiments, the dispensing device and/or receptacle are formed of approximately 50% recycled plastic. The dispensing device and/or receptacle may be BPA-free and phthalate-free. In some embodiments, the first unit and second unit are formed of polypropylene plastic (PP plastic) and the breakable seal is formed of low-density polyethylene plastic (LDPE plastic).

In various embodiments, a dispensing system, including a dispensing device, including the first unit and the second unit, and a receptacle, the dispensing device, and the receptacle may be manufactured and assembled together or separately.

For example, the dispensing device, including the first unit and the second unit, may be manufactured and assembled separately from the receptacle. In some examples, the first unit and the second unit are manufactured and then assembled with a flowable substance. The first unit and the second unit, storing the flowable substance, may later be assembled with the receptacle, which may contain a liquid, such as water.

The term "dispensing device" used herein refers to the first unit and the second unit, described in the figures below.

The term "dispensing system" used herein refers to a dispensing device and a receptacle.

The term "hermetically" used herein refers to an airtight seal of the dispensing device or system. For example, at least one of a protruding seal, a receptacle seal, and interfacing threaded portions in the disclosed technology hermetically seal a dispensing system and keep contents (e.g., food supplement powder stored in the dispensing device of the dispensing system and water stored in the receptacle of the dispensing system) inside the dispensing system stable for over 12 months.

The term "coupling mechanism" used herein refers to any mechanism that is able to couple components of the dispensing system. For example, the coupling mechanism may be complimentary threaded portions, channels and channel receiving portions, clips, friction fits, hinge mechanisms, etc.

The term "guide" used herein refers to text or a symbol that provides instruction to direct a user to apply a force.

Referring to FIG. 1, a dispensing system during a storage phase is shown. Specifically, a flowable substance (15) may be stored inside the dispensing system during the storage phase. The dispensing system includes a device is shown as received by a receptacle (2) in a first position. The dispensing device comprises a first unit (3) and a second unit (4).

The first unit (3) comprises an inner cylindrical projection (5) and an outer cylindrical projection (6) extending from a bottom face (50) of a top wall (7) of the first unit (3). The bottom edge or terminating end (16) of the inner cylindrical projection (5) is tapered in length. Specifically, the bottom edge or terminating end (16) of the inner cylindrical projection (5) is sloped downward from one side of the first unit (3) to the other side of the inner cylindrical projection (5) (also shown as bottom edge (16) in FIG. 3). As a result, one side (shown here as the left side of terminating end 16*a*) of the inner cylindrical projection (5) is shorter than the other side (shown here as the right side of terminating end 16*b*). In some embodiments, a portion of the bottom edge (16) may be shaped (as shown as shaped portion 30 in FIG. 5A and FIG. 5B).

In some embodiments, a portion or all of the bottom edge (16) of the inner cylindrical projection (5) may be linear or a jagged or sharp edge to perforate and cut or break a breakable seal (14) to open the first unit (3) for dispensing. The breakable seal may be formed of any material that is not permeable to air, such as foil, aluminium, metal, plastic, paper, lined paper etc. In some embodiments, the breakable seal (14) seal may be edible, soluble or biodegradable.

As shown in the embodiment in FIG. 1, where the left side of the inner cylindrical projection (5) is shorter than the right side of the inner cylindrical projection (5), in the first position, a small gap portion (42) is maintained between the terminating end (16) on the left side of the inner cylindrical projection (5) and a breakable seal (14). The gap portion (42) may be any size such that the opening of the inner cylindrical projection (5) does not break the breakable seal (14) until a force is applied to the top wall (7) of the dispensing device.

When the first unit (3) and the second unit (4) are assembled together, the first unit (3) may be received by the second unit (4) via a first coupling mechanism (13). The first coupling mechanism (13) comprises a raised collar portion (18) on the outer cylindrical projection (6) of the first unit (3), and a collar receiving portion (44*a*, 44*b*) on the outer cylinder (10) of the second unit (4), adapted to receive the raised collar portion of the first unit (3). In some embodiments, the collar receiving portion (44*a*, 44*b*) is a channel formed by a pair of circumferential projections formed in the inner face of the outer cylinder (10).

The collar receiving portion (44*a*, 44*b*) is a guide for when the first unit (3) is received by the second unit (4) in the first position and facilitates how far a user may initially push the first unit (3) into the second unit (4) in the first position without compromising the breakable seal (14), which occurs in a second position. The raised collar portion (18) "clicks" into place when it moves and is nestled into the collar receiving portion (44*a*, 44*b*). In use, an application of force to the top wall (7) of the first unit (3) can urge the collar portion from the collar receiving portion (44) into the second position and compromise the breakable seal.

Figure 4A:
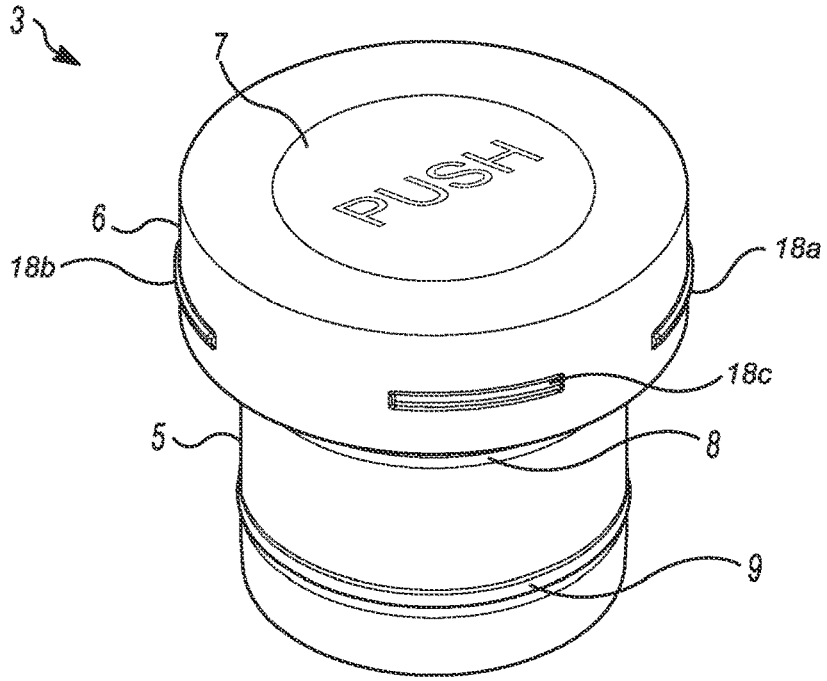
FIG. 4*a* is a perspective top view of an embodiment of the first unit of the dispensing device in accordance with aspects of the present disclosure.
Figure 4B:
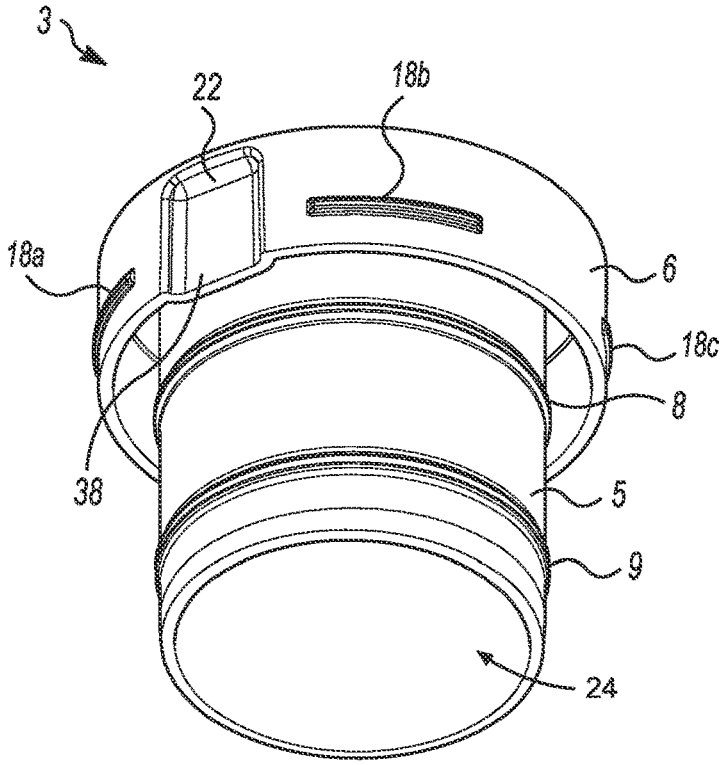
FIG. 4*b* is a perspective bottom view of the embodiment of the first unit of the dispensing device of FIG. 4*a;*
Figure 4C:
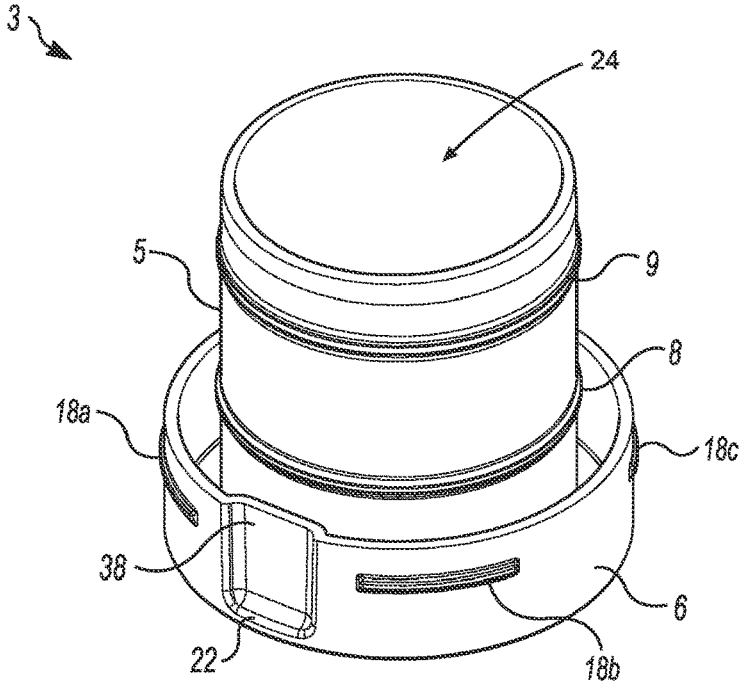
FIG. 4*c* is a perspective bottom view of the embodiment of the first unit of FIG. 4*a* and FIG. 4*b;*

In the first position, the outer cylindrical projection (6) of the first unit (3) may have a channel receiving portion (22) with a join opening (38) (shown and described in detail in FIG. 4*b* and in FIG. 4*c*). The channel receiving portion (22) may be located proximate and in between two protrusions of the broken raised collar portion (e.g., in between raised collar portion 18*a* and 18*b* in FIG. 4B) and adapted to receive a channel (23) located on the outer cylinder (10) of the second unit (4) via the join opening (38) in a second coupling mechanism.

The second coupling mechanism of the channel receiving portion (22) and the channel (23) is located on the shorter side (shown as the left side in FIG. 1) of the inner cylindrical projection (5), which is the portion of the terminating end (16) of the inner cylindrical projection (5) that does not come into contact with the breakable seal (14). The second coupling mechanism provides for a controlled and consistent motion to push the first unit (3) into the second unit (4) to break the breakable seal (14) with the opposing and longer side (shown as the right side in FIG. 1) of the terminating end (16) of the inner cylindrical projection (5). As a result, less pressure and effort are required by a user to break the breakable seal (14).

The breakable seal (14) is configured to close the opening of the inner cylinder (11) for preventing a flowable substance (15) stored in the dispensing device to be released into the receptacle (2). The right side of the inner cylindrical projection (5) is longer than the left side and is located proximate to or in contact with the breakable seal (14) without breaking the breakable seal (14) in the first position.

The flowable substance (15) can be stored within a chamber portion (54) formed by the inner cylindrical projection (5), inner cylinder (11), breakable seal (15) and top wall (7). The breakable seal (14) protects the flowable substance (15) from exposure to unwanted air that may enter via the inner cylindrical projection opening.

In the first position, the inner cylinder projection (5) of the first unit (3) is received by the inner cylindrical (11) of the second unit (4) such that the first and second protruding seals (8, 9) located on the inner cylindrical projection (5) bear on a portion of the inner face of the inner cylinder (11). The protruding seals (8, 9) ensure the chamber portion (54) is hermetically sealed such that excess air will not enter or escape from the chamber portion (54). The protruding seals (8, 9) located on the inner cylindrical projection (5), bear on a portion of the inner face of the inner cylinder (11) such that they are wedged against the inner face of the inner cylinder (11). An oxygen barrier is created at the location of the one or more protruding seals (8, 9) bearing on the inner cylinder (11). The protruding seals (8, 9) ensure the flowable substance (15) remains fresh in the chamber portion (54) for at least 12 months. In an embodiment with the dispensing device attached to a receptacle (2), the protruding seals (8, 9) ensure that the flowable substance (15) and water stored in the receptacle (2) remain stable.

The outer cylinder (10) of the second unit (4) is adapted to receive the receptacle (2) by way of complimentary threaded portions (34*a*, 34*b*) located on the outer cylinder (10) and receptacle (2) respectively. When interfaced, the threaded portions (34*a* and 34*b*) located on the outer cylinder (10) and receptacle (2) provide an air-tight enclosure such that no liquid is able to escape the receptacle (2) unless the receptacle (2) is uncoupled from the dispensing device.

The second unit (4) comprises an outer cylinder (10) and an inner cylinder (11) joined by a bridging portion (12). The bridging portion (12) is adapted to bear on an upper face (46) of the receptacle (2), and a receptacle seal (19) projecting from the bridging portion (12) bears on an inner face (48) of the receptacle (2) perpendicular to the upper face (46). An oxygen barrier is created at the locations of the bridging portion (12) bearing on an upper face (46) of the receptacle (2), and a receptacle seal (19) projecting from the bridging portion (12) bearing on an inner face (48) of the receptacle (2) perpendicular to the upper face (46). The receptacle seal (19) is also used to prevent water leaking from the receptacle (2). In an embodiment, increased pressure from inside the receptacle (2) causes the receptacle seal (19) to more greatly press against the inner face (48) of the receptacle (2), increasing the strength of the receptacle seal (19) and sealing inside the contents (17) of the receptacle (2).

The receptacle seal (19) may project from the bridging portion (12) continually or may be broken into numerous portions which project from the bridging portion (12). The receptacle seal (19) may be any shaped projection (e.g., triangular, circular, square, rectangular, etc.). The receptacle seal (19) may terminate in a chamfered or bevelled edge.

Figure 2:
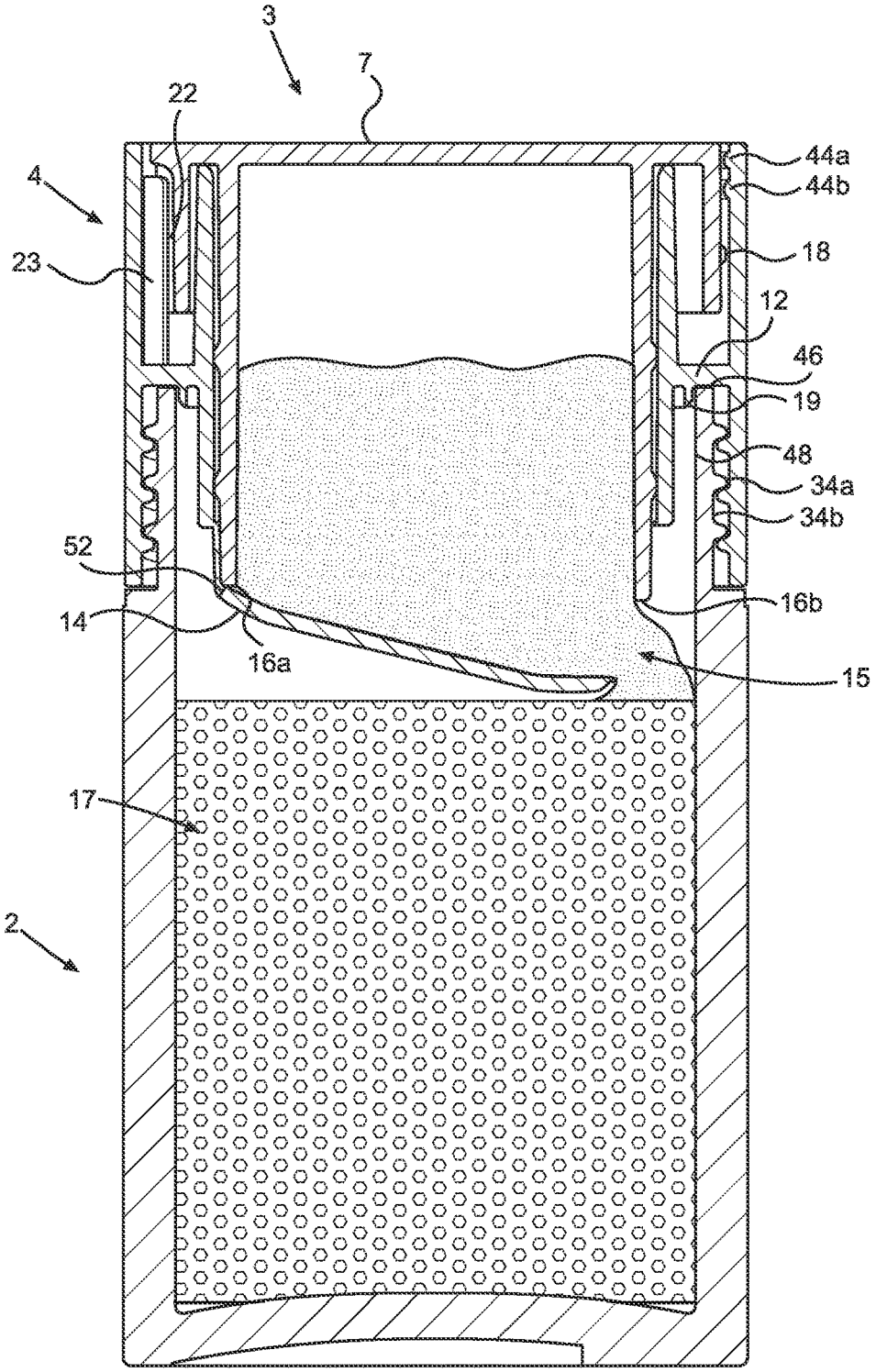
FIG. 2 is a cross-sectional front view of the dispensing device and the receptacle in accordance with aspects of the present disclosure in a second position.

FIG. 2 depicts the dispensing system of FIG. 1 in a dispensing phase. Specifically, when a user desires access to the flowable substance stored in the dispensing device, the from the first position dispensing system is moved from the first position to a second position. In particular, an application of force has been applied to the top wall (7) of the first unit (3), lowering the inner cylindrical projection (5) into the inner cylinder (11), lowering the shorter side terminating end 16*a* of the inner cylindrical projection (5) into the gap portion (42) (not shown, as it has been decreased or eliminated), lowering the longer side terminating end 16*b* of the inner cylindrical projection (5) to contact and break the breakable seal (14), and releasing the flowable substance (15) into the receptacle (2).

A person skilled in the art would appreciate that disruption of the breakable seal (14) is understood to mean the breakable seal (14) is broken or torn, such that the flowable substance (15) is able to move passed the breakable seal (14) out of the chamber (54).

When the receptacle (2) is coupled to the dispensing device, the receptacle (2) is air-tight such that no liquid is able to escape the receptacle (2) unless uncoupled from the dispensing device. When the flowable substance (15) enters the receptacle (2) via the disruption of the breakable seal (14), the flowable substance (15) can be mixed with the contents (17) in the receptacle (2). In some embodiments, the mixing of the flowable substance (15) and the contents (17) is achieved by movement of the receptacle (2) and dispensing device, such as by shaking or swirling. In the event the flowable substance (15) is effervescent, no movement is required for mixing.

A person skilled in the art would appreciate that in another embodiment, the breakable seal (14) may fall into the receptacle (2) when the dispensing device is moved into the second position and there is disruption of the breakable seal (14). In some embodiments, the dispensing device may be not be coupled with the receptacle (2) or used without a receptacle (2). In such embodiments, the flowable substance (15) may be released into another desired location (e.g., directly into a drinking glass or) dispensed into the air and onto food on a plate).

In one embodiment, a portion of the breakable seal (14) may remain affixed to the inner cylinder (11) such that the breakable seal (14) does not fall into the receptacle (2) due to an affixing means which does not become broken when the dispensing device is moved into the second position. The affixing means may include part of the inner cylinder (11), a portion of the breakable seal (14) itself, or a connector (52), for example, as shown in FIGS. 1 and 2. The attachment of the connector (52) to the inner cylinder (11) and to the breakable seal (14) allows the flowable substance (15) to enter into the receptacle (2) yet allows the breakable seal (14) to remain fixed to the second unit (4). In some embodiments, when the first unit (3) is pushed down into the second unit (4) in the second position, the shorter side of the inner cylindrical projection (5) locates proximate to, but does not break, the connector (52) or the breakable seal (14), keeping a portion of the breakable seal (14) attached to the inner cylinder (11).

A person skilled in the art would appreciate that the connector (52) may be the use of thicker material, no perforations where other regions of the breakable seal (14) are perforated, etc. In some embodiments the affixing means may be part of the inner cylinder (11), part of the breakable seal (14), or its own individual component.

In some embodiments, the material of the breakable seal (14) is tapered in thickness from a center of the breakable seal towards the outer circumference of the seal (14) such that the material in or near the outer circumference of the breakable seal (14) is thinner than the material in the center of the breakable seal to ensure the inner cylindrical projection (5) is able to break the breakable seal (14). In some embodiments, the inner cylindrical projection (5) comprises a cut-away portion such that when there is an application of force to the top wall (7) of the first unit (3), the inner cylindrical projection (5) including at least a portion of the cut away portion is lowered into and beyond the gap portion (42) to break the breakable seal (14). However, the portion of the breakable seal (14) where the cut-away portion is lowered is not broken, such that the portion of the breakable seal (14) remains joined to the opening of the inner cylinder (11) and does not fall into the receptacle (2). This allows the flowable substance (15) to enter into the receptacle (2) yet allows the breakable seal (14) to remain fixed to the second unit (4).

In an embodiment, the breakable seal (14) may be joined to the dispensing device via a hinge mechanism or may be integrally joined to the second unit (4) via a heat seal or other joining means. The material of the breakable seal (14) may be tapered in thickness from a center towards a circumference of the seal (14), where the breakable seal (14) has a greater thickness in the center of the breakable seal (14) and a lesser thickness at the edges of the breakable seal (14) or may be the same thickness throughout. In an embodiment wherein the breakable seal (14) is joined to the dispensing device via a hinge mechanism, the hinge mechanism retains the breakable seal such the breakable seal (14) does not separate from the second unit (4).

The application of force to the top wall (7) of the first unit (3) urges the collar portion (18) from the collar receiving portion (44*a*, 44*b*) into the second position to compromise the breakable seal. The collar portion (18) is located outside of and proximate to the collar receiving portion (44*a*, 44*b*) in the second position.

In the second position, the channel receiving portion (22) has received the channel (23), and the channel (23) has moved further into the channel receiving portion (22). The channel receiving portion (22) and the channel (23) provide for a controlled and consistent motion to push the first unit (3) into the second unit (4) to break the breakable seal (14) in a second position. Also, as a result of the channel receiving portion and the channel, less pressure and effort may be required by a user to break the breakable seal (14).

In the second position, the protruding seals (8, 9) located on the inner cylindrical projection (5) are moved adjacent to and remain bearing on a portion of the inner face of the inner cylinder (11) such that they are wedged against the inner face of the inner cylinder (11). The oxygen barrier remains at the location of the one or more protruding seals (8, 9) bearing on the inner cylinder (11).

In the second position, the threaded portions (34*a* and 34*b*) located on the outer cylinder (10) and receptacle (2) maintain the air-tight enclosure such that no liquid is able to escape the receptacle (2) unless uncoupled from the dispensing device. The bridging portion (12) bears on an upper face (46) of the receptacle (2), and the receptacle seal (19) projecting from the bridging portion (12) bears on the inner face (48) of the receptacle (2) perpendicular to the upper face (46).

Figure 3:
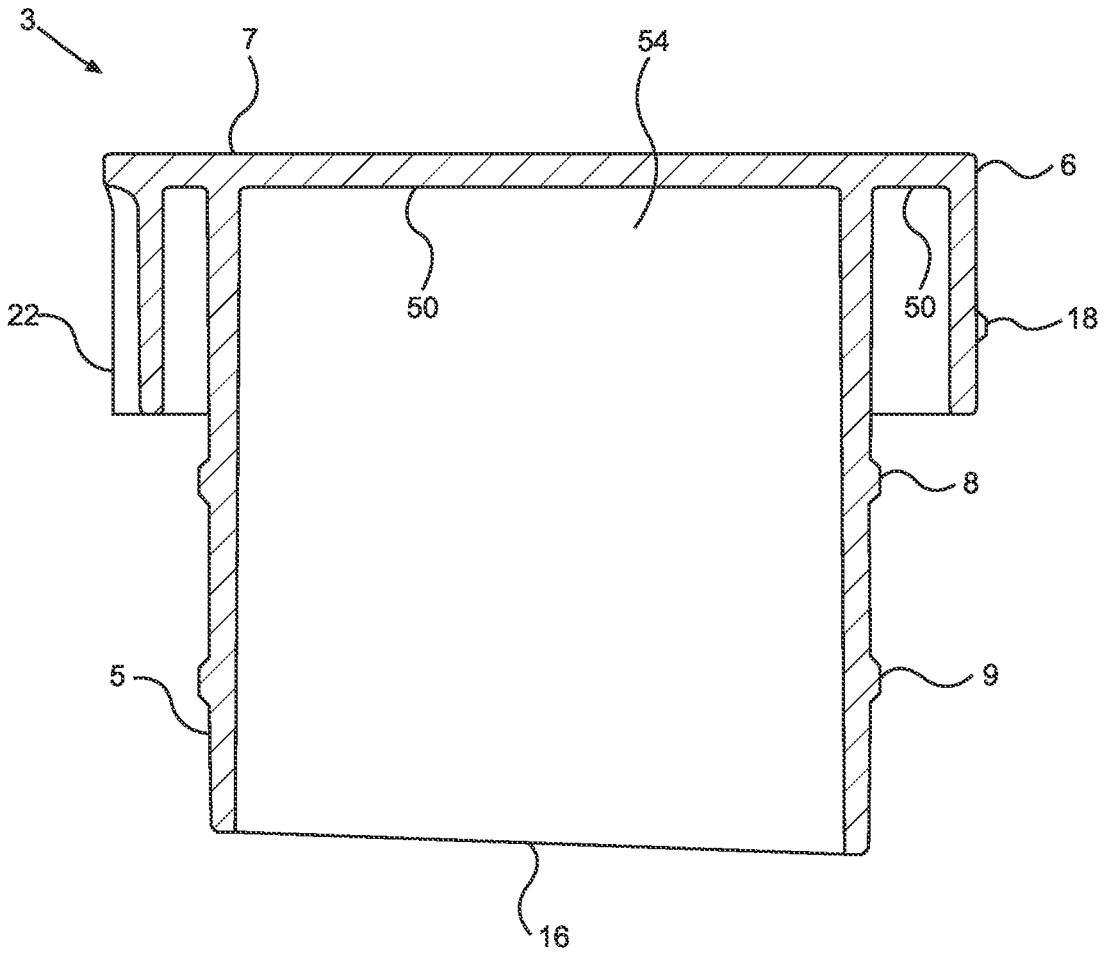
FIG. 3 is a cross-sectional front view of the first unit of the dispensing device in accordance with aspects of the present disclosure.

FIG. 3 illustrates a cross-sectional side view an embodiment of the first unit (3) in greater detail. In particular, the first unit (3) comprises a top wall (7) with an inner cylindrical projection (5) and an outer cylindrical projection (6) extending from a bottom face (50) of the top wall (7). A pair of protruding seals (8, 9) are located on the inner cylindrical projection (5) adapted to bear on the inner cylinder (11) of the second unit (4) such that they are wedged against the inner face of the inner cylinder (11). The second protruding seal (9) is located below the first protruding seal (8) towards the opening of the inner cylinder (11). The protruding seals (8, 9) ensure the chamber (54) is airtight such that excess air will not enter or escape from the chamber (54). An oxygen barrier is created at the location of the one or more protruding seals (8, 9) bearing on the inner cylinder (11). The seals ensure the flowable substance (15) (shown in FIG. 1 and in FIG. 2) remains fresh in the chamber for at least 12 months.

In the first position, a small gap portion (42) (shown in FIG. 1) is maintained between the terminating end (16) on the left side of the inner cylindrical projection (5) and a breakable seal (14) located to close the opening of the inner cylinder (11) for preventing a flowable substance (15) stored in the dispensing device to be released into the receptacle (2). As a result, the left side of the inner cylindrical projection (5) is shorter than the right side of the inner cylindrical projection (5). The right side of the inner cylindrical projection (5), longer than the left side, is located proximate to or in contact with the breakable seal (14) without breaking the breakable seal (14) in the first position (as shown in FIG. 1).

In some embodiments, when the first unit (3) is pushed down into the second unit (4) in the second position, the shorter side of the inner cylindrical projection (5) locates proximate to, but does not break, the connector (52) or the breakable seal (14), keeping a portion of the breakable seal (14) attached to the inner cylinder (11) (as shown in FIG. 2).

Referring to FIG. 3, the shorter side of the inner cylindrical projection (5) may be located toward a side of the first unit (3) where the channel receiving portion (22) with a join opening (38) (shown in FIG. 4*b* and in FIG. 4*c*) are located. The channel receiving portion (22) may be adapted to receive a channel (23) (shown in FIG. 6) located on the outer cylinder (10) of the second unit (4) via the join opening (38). The coupling mechanism of the channel receiving portion (22) and the channel (23) provide for a controlled and consistent motion to push the first unit (3) into the second unit (4) to break the breakable seal (14) in the second position. Less pressure and effort are required by a user to break the breakable seal (14) with the opposing right side of the inner cylindrical projection (5).

A raised collar portion (18) (shown in FIGS. 4*a*-*c*) is located on the outer cylindrical projection (6) of the first unit (3), which is adapted to be received by a collar receiving portion (44*a*, 44*b*) on the outer cylinder (10) of the second unit (4). In use, an application of force to the top wall (7) of the first unit (3) urges the collar portion from the collar receiving portion (44*a*, 44*b*).

FIGS. 4*a*, 4*b*, and 4*c* illustrate perspective views of an embodiment of the first unit (3). In particular, the first unit (3) comprises a top wall (7) with a guide. A guide may be text or a symbol that guides a user in how to operate the dispensing device (e.g., the words "PUSH" or "PRESS"). As shown here, the guide is embossed letters for the word "PUSH" located on the top face of the top wall (7) to direct where a user is to apply force to release the flowable substance (15) from the dispensing device. The inner cylindrical projection (5) and outer cylindrical projection (6) extend from the bottom face (50) of the top wall (7). A pair of protruding seals (8, 9) are located on the inner cylindrical projection (5) adapted to bear on the inner cylinder (11) of the second unit (4).

The outer cylindrical projection (6) comprises a broken raised collar portion (18) on its outer wall, wherein the broken raised collar portion (18) is formed of more than one collar portion running along the outer face of the outer cylindrical projection (6). For example, the broken raised collar portion (18) may comprise of multiple horizontal protrusions (shown in FIGS. 4*a*, 4*b*, and 4*c* as collar portions 18*a*, 18*b*, and 18*c*) extending outward from the outer face of the outer cylindrical projection (6). The broken raised collar portion (18) may have more than one single protrusion as the one single protrusion embodiment requires more pressure to break the breakable seal (14) as the dispensing device moves from a first position to a second position. The raised collar portion facilitates easier movement of the dispensing device from the first position to the second position to break the breakable seal (14).

In an embodiment, a channel receiving portion (22) may also be located on the outer face of the outer cylindrical projection (6). The channel receiving portion 22 may be located in between two protrusions of the broken raised collar portion (18) and adapted to receive a channel (23) located on the outer cylinder (10) of the second unit (4) (shown in FIG. 8*c*) via the join opening (38). The channel receiving portion and the channel provide for a controlled and consistent motion to push the first unit (3) into the second unit (4) from the first position to the second position to break the breakable seal (14). As a result of the channel receiving portion and the channel, less pressure and effort may be required by a user to break the breakable seal (14).

In some embodiments, the shorter side of the inner cylindrical projection (5) may be located toward a side of the first unit (3) where the channel receiving portion (22) with a join opening (38) are located, while the longer side of the inner cylindrical projection (5) is located opposite the channel receiving portion (22) and join opening (38). The location of the shorter side of the inner cylindrical projection (5) proximate the channel receiving portion (22) and join opening (38) and the longer side of the inner cylindrical projection (5) being located opposite the channel receiving portion (22) and join opening (38) further facilitates easier movement of the dispensing device from a first position to a second position.

Figure 5A:
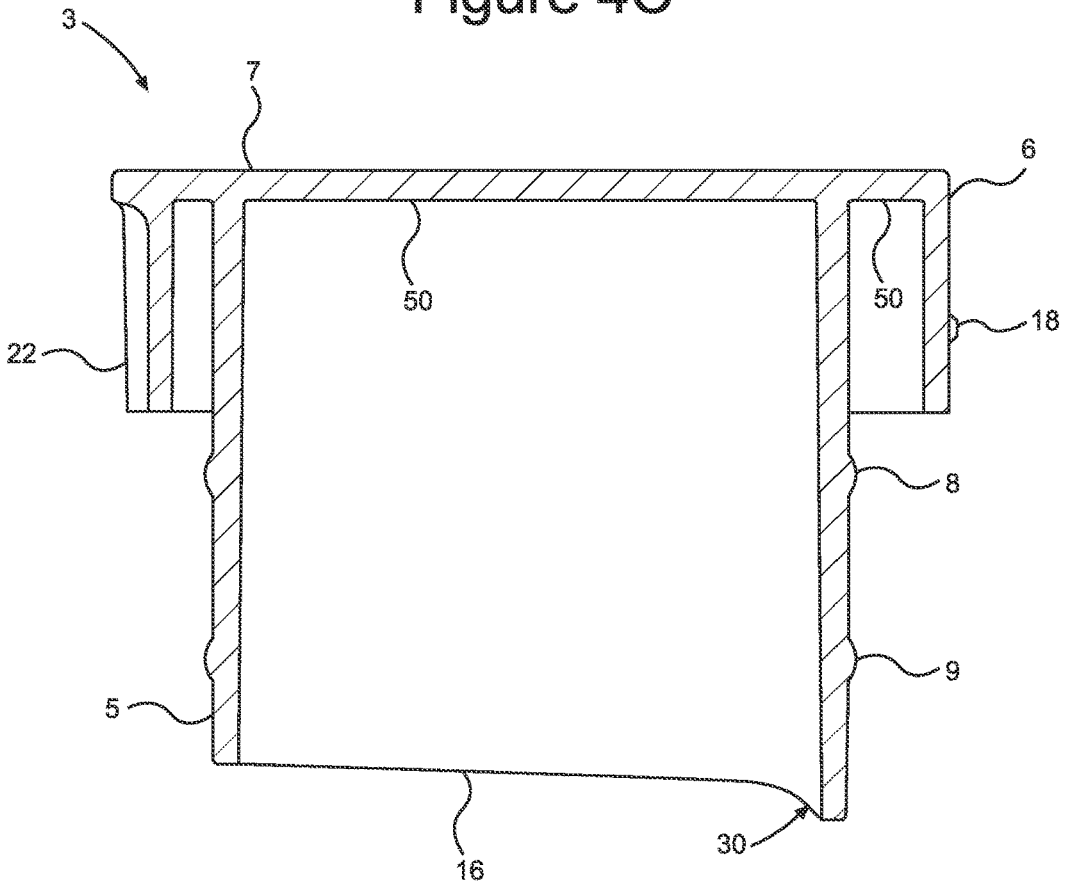
FIG. 5*a* is a cross-sectional front view of the first unit of the dispensing device in accordance with aspects of the present disclosure.

FIG. 5*a* is a cross-sectional front view of the first unit of the dispensing device in accordance with another embodiment of the disclosure. In particular, the first unit (3) comprises a top wall (7) with an inner cylindrical projection (5) and an outer cylindrical projection (6) extending from a bottom face (50) of the top wall (7). A pair of protruding seals (8, 9) are located on the inner cylindrical projection (5) adapted to bear on the inner cylinder (11) of the second unit (4) such that they are wedged against the inner face of the inner cylinder (11). The second protruding seal (9) is located below the first protruding seal (8) towards the opening of the inner cylinder (11). The protruding seals (8, 9) ensure the chamber (54) is airtight such that excess air will not enter or escape from the chamber (54). An oxygen barrier is created at the location of the one or more protruding seals (8, 9) bearing on the inner cylinder (11). The seals ensure the flowable substance (15) remains fresh in the chamber for at least 12 months.

The terminating end (16) on the inner cylindrical projection (5) may slope from one end to another. This sloping is depicted in the figures with the left side of the inner cylindrical projection (5) being shorter than the right side of the inner cylindrical projection (5). As a result, in the first position, a small gap portion (42) (shown in FIG. 1) is maintained between the terminating end (16) on the left side of the inner cylindrical projection (5) and a breakable seal (14) that closes the opening of the inner cylinder (11) for preventing a flowable substance (15) stored in the dispensing device to be released into the receptacle (2). The right side of the inner cylindrical projection (5) is longer than the left side and is located proximate to or in contact with the breakable seal (14) without breaking the breakable seal (14) in the first position (as shown in FIG. 1).

In some embodiments, when the first unit (3) is pushed down into the second unit (4) in the second position, the shorter side of the inner cylindrical projection (5) locates proximate to, but does not break, the connector (52) or the breakable seal (14), keeping a portion of the breakable seal (14) attached to the inner cylinder (11) (as shown in FIG. 2). The right side of the inner cylindrical projection (5) is longer than the left side and is located proximate to or in contact with the breakable seal (14) without breaking the breakable seal (14) in the first position (as shown in FIG. 1).

Figure 5B:
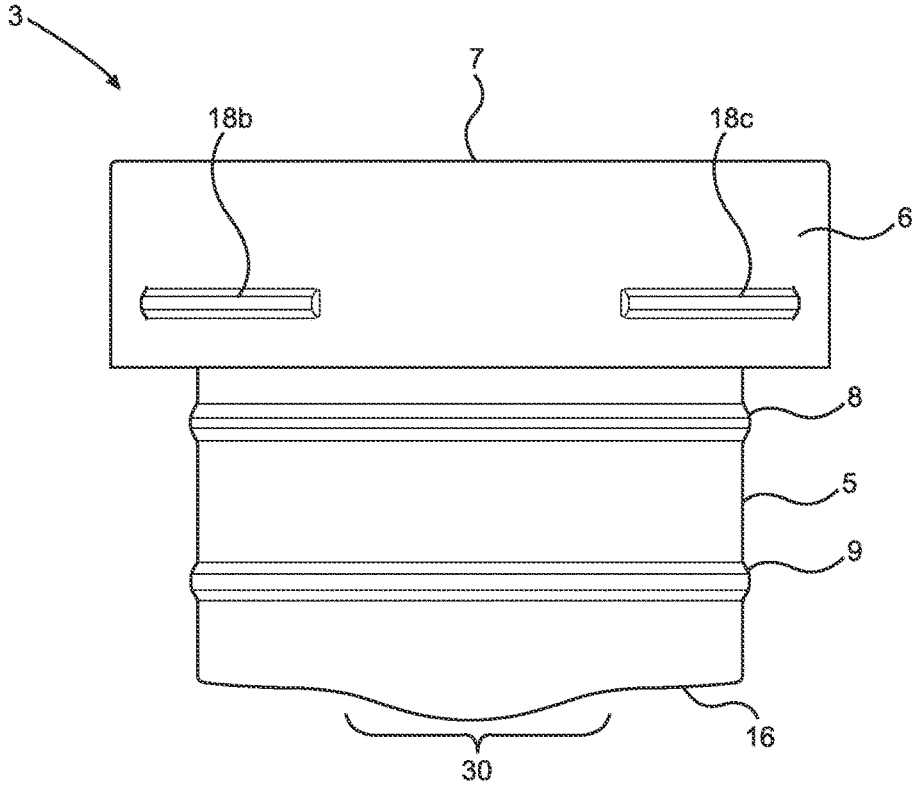
FIG. 5*b* is a side view of an embodiment of the first unit of the dispensing device of FIG. 5*a;*

FIG. 5*a* and FIG. 5*b* illustrate a front view and a perspective bottom view of the first unit of the dispensing device. The channel receiving portion (22) may be adapted to receive a channel (23) located on the outer cylinder (10) of the second unit (4) via the join opening (38). The coupling mechanism of the channel receiving portion (22) and the channel (23) provide for a controlled and consistent motion to push the first unit (3) into the second unit (4) to break the breakable seal (14) in the second position. Less pressure and effort are required by a user to break the breakable seal (14) with the opposing right side of the inner cylindrical projection (5).

In some embodiments, the shorter side of the inner cylindrical projection (5) may be located toward a side of the first unit (3) where the channel receiving portion (22) with a join opening (38) are located, while the longer side of the inner cylindrical projection (5) is located opposite the channel receiving portion (22) and join opening (38). The location of the shorter side of the inner cylindrical projection (5) proximate the channel receiving portion (22) and join opening (38) and the longer side of the inner cylindrical projection (5) being located opposite the channel receiving portion (22) and join opening (38) further facilitates easier movement of the dispensing device from a first position to a second position.

Figure 5C:
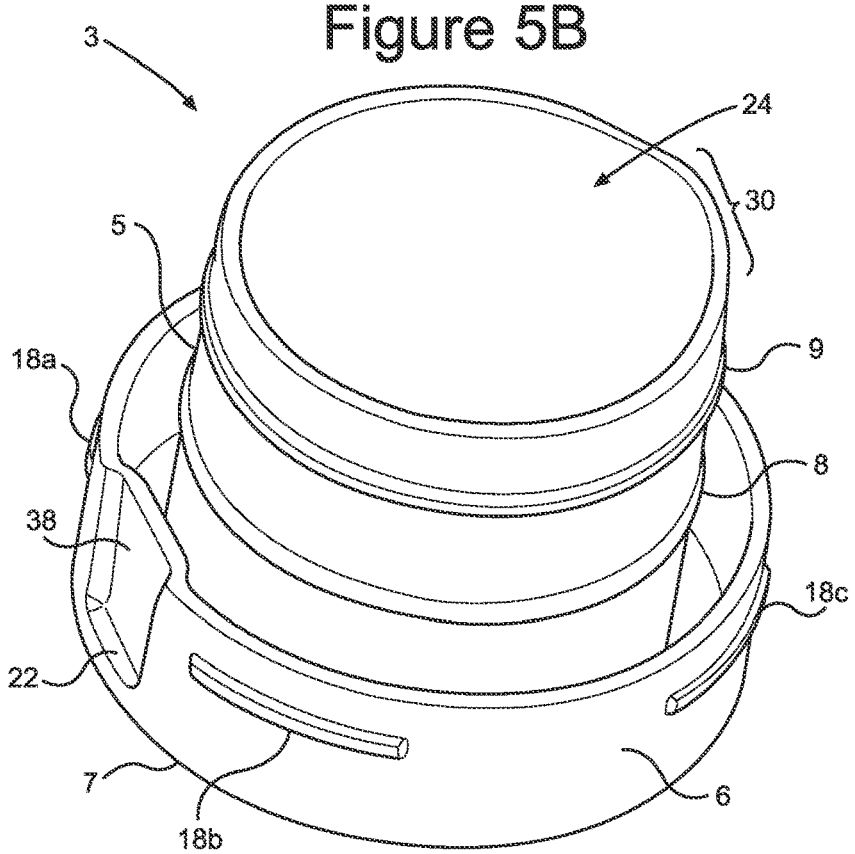
FIG. 5*c* is a perspective bottom view of the embodiment of the first unit of the dispensing device of FIG. 5*a* and FIG. 5*b;*

A raised collar portion (18*b* and 18*c* in FIGS. 5*b* and 5*c*) is located on the outer cylindrical projection (6) of the first unit (2), which is adapted to be received by a collar receiving portion (44*a*, 44*b*) on the outer cylinder (10) of the second unit (4). In use, an application of force to the top wall (7) of the first unit (3) urges the collar portion from the collar receiving portion (44*a*, 44*b*).

Figure 6:
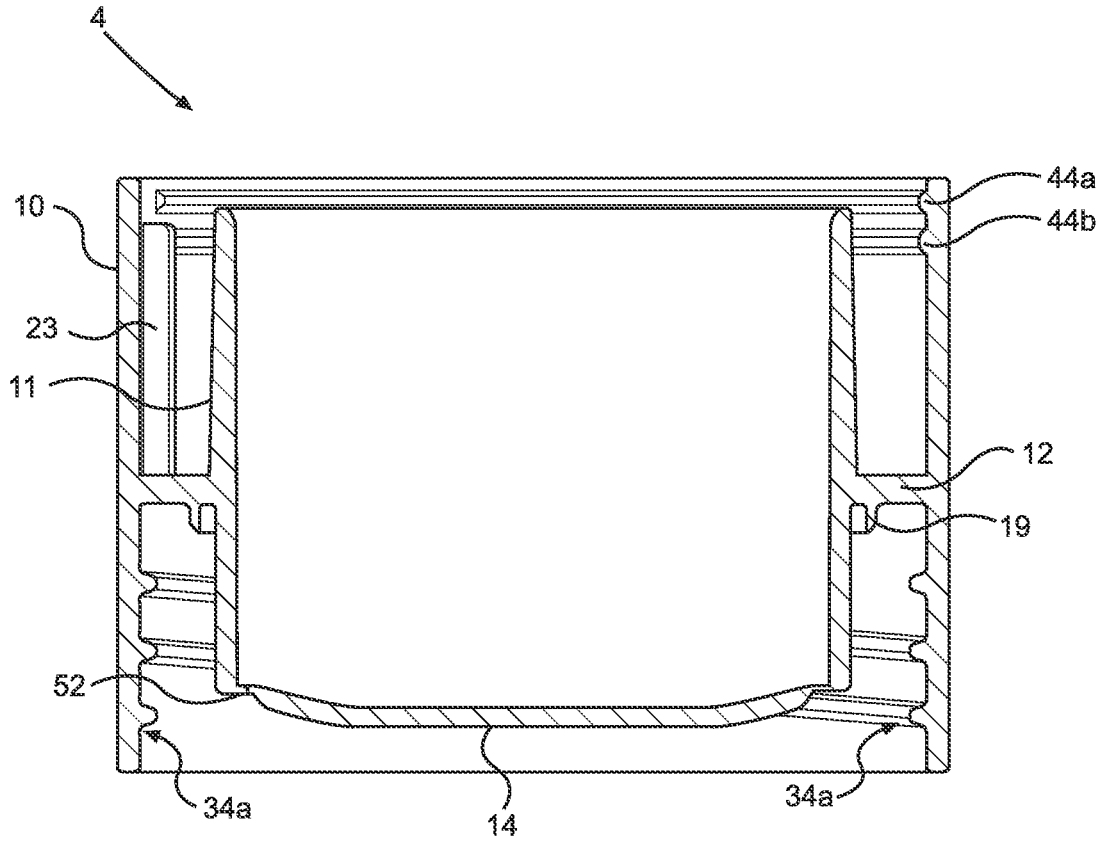
FIG. 6 is a cross-sectional front view of the second unit of the dispensing device in accordance with aspects of the present disclosure.

FIG. 6 is a cross-sectional front view of the second unit of the dispensing device in accordance with an embodiment of the disclosure. In particular, the second unit (4) comprises an outer cylinder (10) and an inner cylinder (11) joined by a bridging portion (12). The inner cylinder (11) is shorter in length than the outer cylinder (12). The lower portion of the outer cylinder (10) comprises a threaded portion (34*a*) for receiving a complimentary threaded portion (34*b*) of the receptacle (2). The upper portion of the outer cylinder (10) comprises a collar receiving portion (44*a*, 44*b*) adapted to receive the raised collar portion (18) of the first unit (3). In the illustrated embodiment, the collar receiving portion (44*a*, 44*b*) is a channel formed by a pair of circumferential projections. formed on the inner face of the outer cylinder (10).

A breakable seal (14) is located at the opening of the inner cylinder (11) for allowing and preventing a flowable substance (15) stored in the dispensing device to be released into the receptacle (2). The breakable seal (14) protects the flowable substance (15) from exposure to the contents (17) of the receptacle (2) until the breakable seal (14) is broken or disrupted.

A receptacle seal (19) projects from the bridging portion (12) of the second unit (4) adapted to bear on an inner face (48) of the receptacle (2). The receptacle seal (19) is used to prevent the receptacle (2) contents such as water from leaking from the receptacle (2). In an embodiment, increased pressure from inside the receptacle causes the receptacle seal (19) to more greatly press against the inner face (48) of the receptacle (2), increasing the strength of the receptacle seal (19) and sealing inside the contents (17) of the receptacle (2).

Figure 7A:
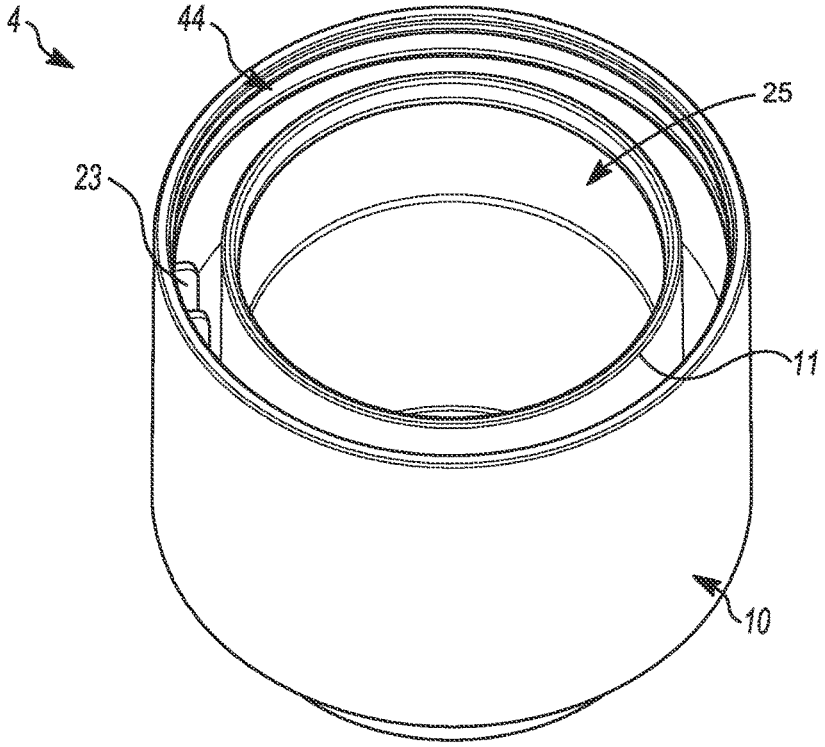
FIG. 7*a* is a top perspective view of the first unit of the dispensing device in accordance with aspects of the present disclosure.
Figure 7B:
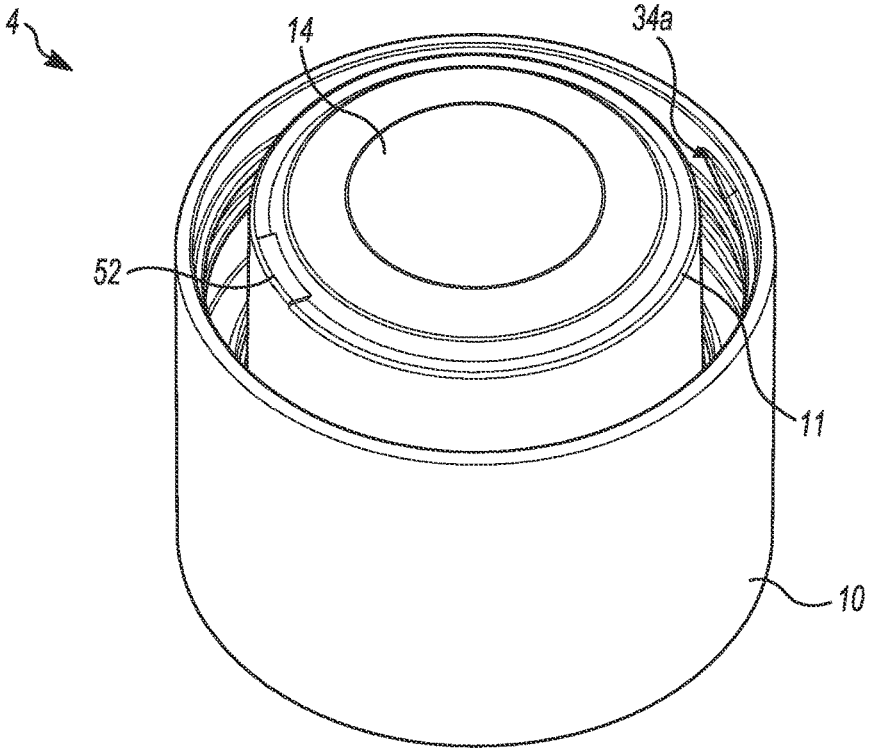
FIG. 7*b* is a bottom perspective view of the first unit of FIG. 7*a;*

FIG. 7*a* is a top perspective view of the second unit (4) of the dispensing device in accordance with an embodiment of the disclosure. FIG. 7*b* is a bottom perspective view of the second unit (4) of FIG. 7*a*, with the second unit (4) upside down. A channel (23) and a collar receiving portion (44) are located on the outer cylinder (10) of the second unit (4). A breakable seal (14) is located on the bottom of the inner cylinder (11) of the second unit (4). In some embodiments, the breakable seal (14) may be part of or connected directly to the inner cylinder (11) or it may be connected to the inner cylinder (11) by a connector (52). A connector (52) is shown in FIG. 7A connecting the breakable seal (14). When the breakable seal (14) is broken during use, the connector (52) holds the breakable seal (14) onto the inner cylinder (11) of the second unit (4).

The outer cylinder (10) of the second unit (4) is adapted to receive the receptacle (2) by way of complimentary threaded portions (34*a*, 34*b*) located on the outer cylinder (10) and receptacle (2) respectively. The threaded portions (34*a*) are shown in FIG. 7*b* located on the outer cylinder (10). When interfaced, the threaded portions (34*a* and 34*b*) located on the outer cylinder (10) and receptacle (2) provide an air-tight enclosure such that no liquid is able to escape the receptacle (2) unless the receptacle (2) is uncoupled from the dispensing device.

Figure 8:
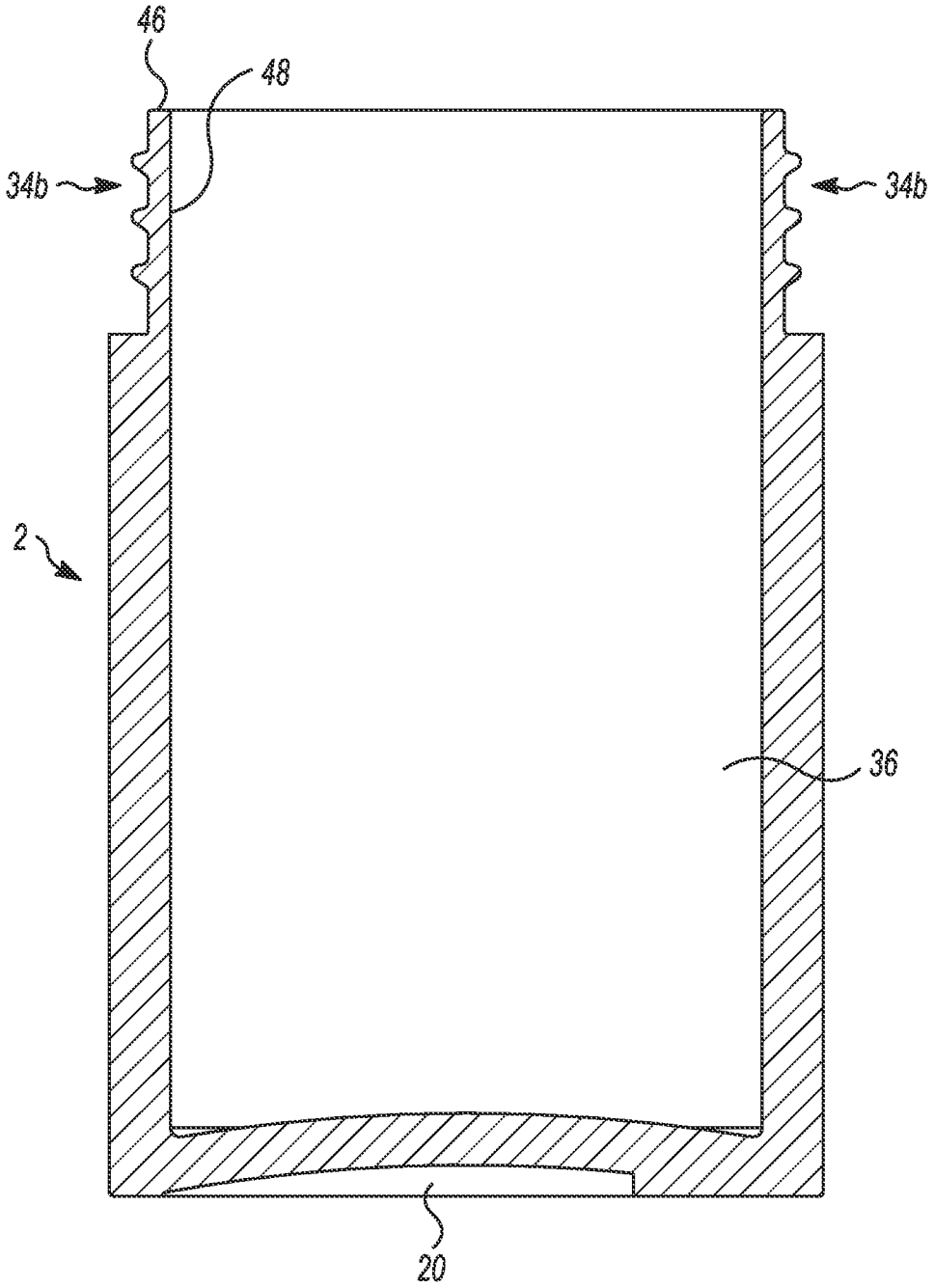
FIG. 8 is a cross-sectional front view of the receptacle in accordance with aspects of the present disclosure.
Figure 9A:
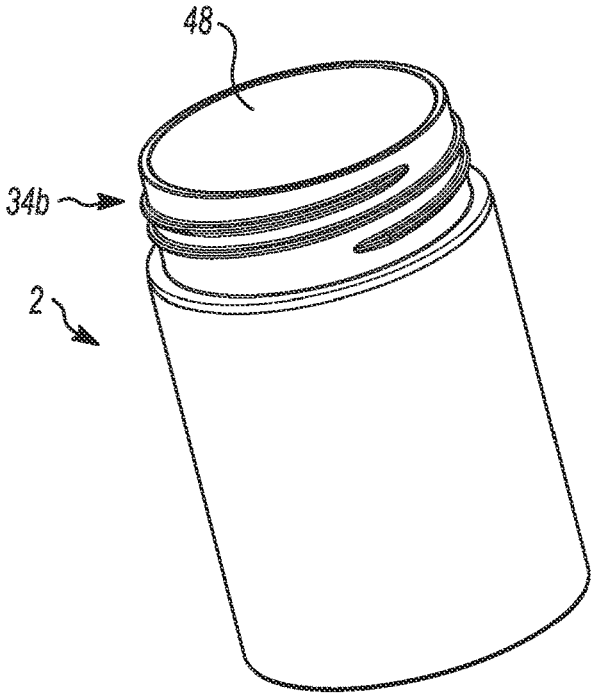
FIG. 9*a* is a top perspective view of the receptacle of FIG. 8.
Figure 9B:
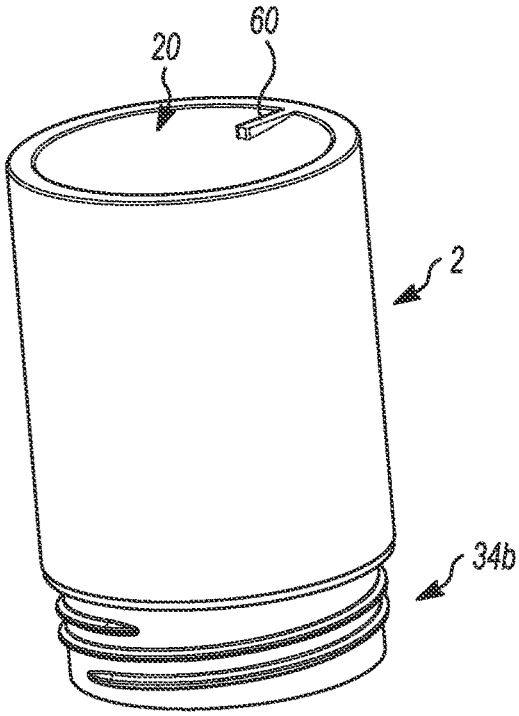
FIG. 9*b* is a bottom perspective view of the receptacle of FIG. 8 and FIG. 9*a;*

FIG. 8 is a cross-sectional front view of the receptacle (2) in accordance with an embodiment of the disclosure. FIG. 9*a* is a top perspective view of the receptacle (2) of FIG. 8. FIG. 9*b* is a bottom perspective view of the receptacle (2) of FIG. 8 and FIG. 9*a*, with the receptable (2) upside down.

The outer cylinder (10) of the second unit (4) is adapted to receive the receptacle (2) by way of complimentary threaded portions (34*a*, 34*b*) located on the outer cylinder (10) and receptacle (2) respectively. The threaded portions (34*b*) are shown in FIGS. 9*a* and 9*b* located on the receptacle (2). When interfaced, the threaded portions (34*a* and 34*b*) located on the outer cylinder (10) and receptacle (2) provide an air-tight enclosure such that no liquid is able to escape the receptacle (2) unless the receptacle (2) is uncoupled from the dispensing device.

The receptacle (2) comprises a receptacle chamber portion (36), which is adapted to be filled with contents, such as liquid.

In an embodiment, the receptacle (2) may comprise a wedge portion (20) at the base of the receptacle for applying stickers and manufacturing details. A label guide (60) may be included in some embodiments for printing a label on the receptacle (2).

In some embodiments, the receptacle (2) may comprise a mouthpiece located on the receptacle (2) or a mouthpiece may be configured to attach to the receptacle (2) for a user to drink from the receptacle (2).

Figure 10A:
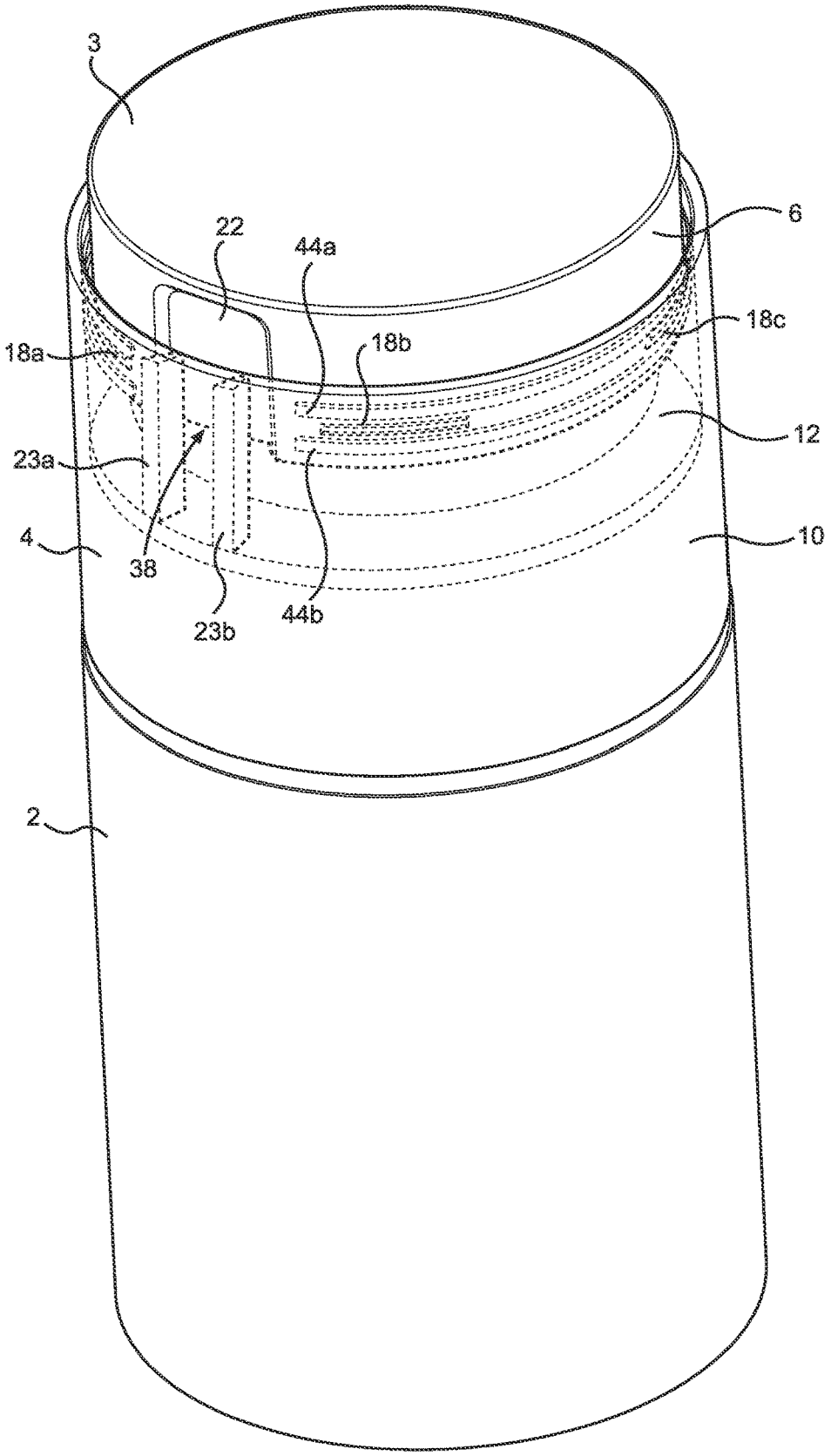
FIG. 10*a* is a cross-sectional front perspective view of the dispensing device in accordance with aspects of the present disclosure in a first position.
Figure 10B:
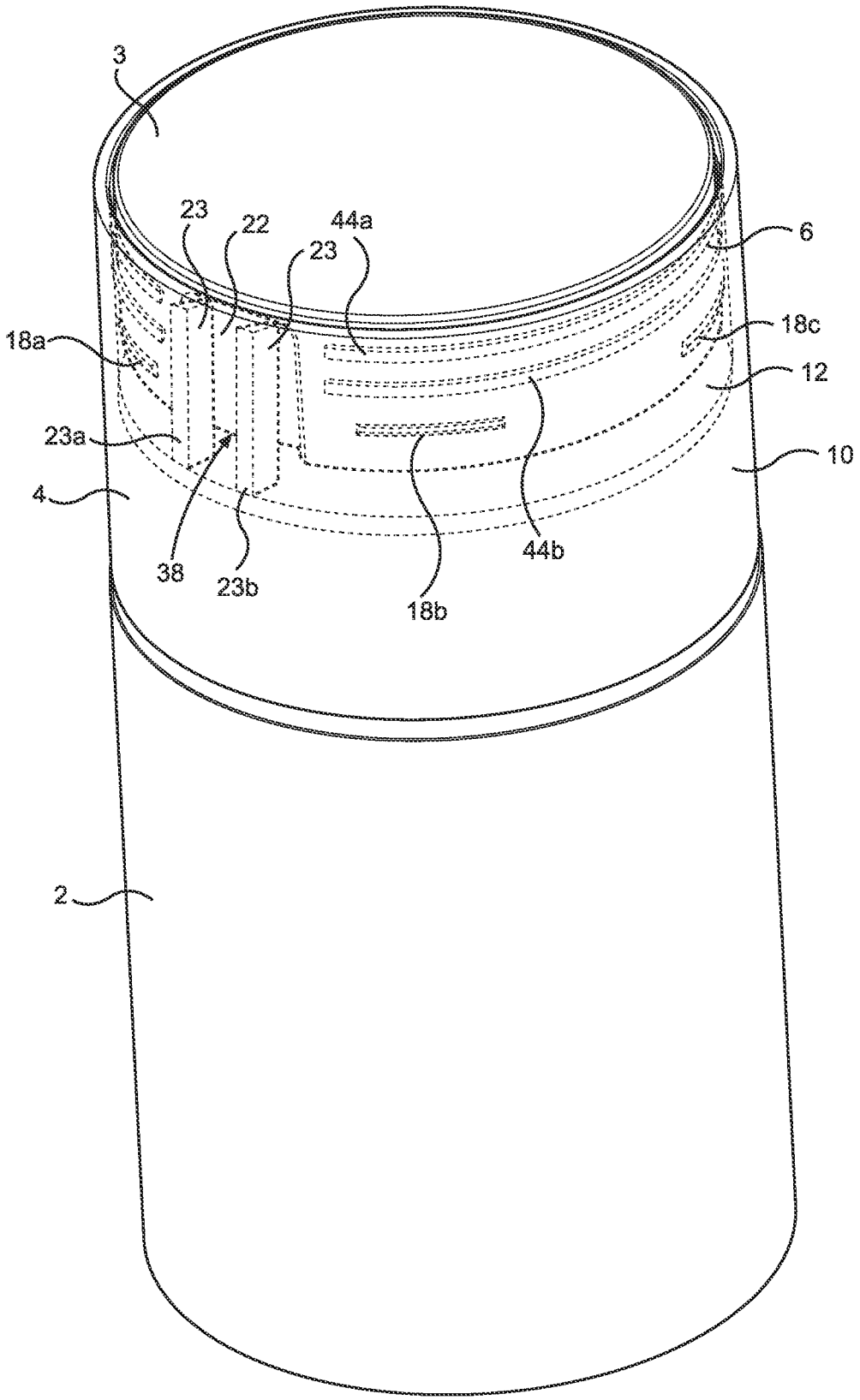
FIG. 10*b* is a cross-sectional front perspective view of the dispensing device of FIG. 10*a* in a second position.

FIG. 10*a* and FIG. 10*b* are cross-sectional front perspective views of the dispensing device in accordance with an embodiment of the disclosure in a first position and in a second position, respectively. More specifically, FIG. 10*a* and FIG. 10*b* illustrate a first coupling mechanism and a second coupling mechanism (21) to couple the first unit (3) and the second unit (4). The first unit (3), the second unit (4), and the receptacle (2) are shown.

The first unit (3) is received by the second unit (4) via a first coupling mechanism. The first coupling mechanism comprises a raised collar portion (18) on the outer cylindrical projection (6) of the first unit (3), and a collar receiving portion (44*a*, 44*b*) on the outer cylinder (10) of the second unit (4) adapted to receive the raised collar portions (18) of the first unit (3). In some embodiments, the collar receiving portion (44*a*, 44*b*) is a channel formed by a pair of circumferential projections formed in the inner face of the outer cylinder (10).

The collar receiving portion (44*a*, 44*b*) is a guide for when the first unit (3) is received by the second unit (4) in the first position and facilitates how far a user may initially push the first unit (3) into the second unit (4) in the first position without compromising the breakable seal (14) in a second position. The raised collar portions (18) "click" into place when the raised collar portions (18) move into and are nestled into the collar receiving portion (44*a*, 44*b*).

The second coupling mechanism (21) comprises the channel receiving portion (22) of the outer cylindrical projection (6) of the first unit (3) having a join opening (38). The channel receiving portion (22) of the outer cylindrical projection (6) of the first unit (3) is adapted to receive the channel (23) located on the outer cylinder (10) of the second unit (4) (shown in FIG. 10*a*) via the join opening (38). The channel (23) bears on a portion of the channel receiving portion (22). The channel (23) may be comprised of a pair of parallel projections (shown here as channel (23*a*) and (23*b*)) extending from the outer cylinder (10) and running a portion of the length of the outer cylinder (10) proximate to the bridging portion (12).

Referring to FIG. 10*b*, when the dispensing device is moved into the second position due to an application of force to the top wall (7) of the first unit (3), the force urges the raised collar portions (18) out of the collar receiving portion (44*a*, 44*b*) and guides the channel (23) along the channel receiving portion (22) until bearing on a closed end of the channel receiving portion (22) opposite the join opening (38), and the breakable seal (14) is compromised.

Figure 11:
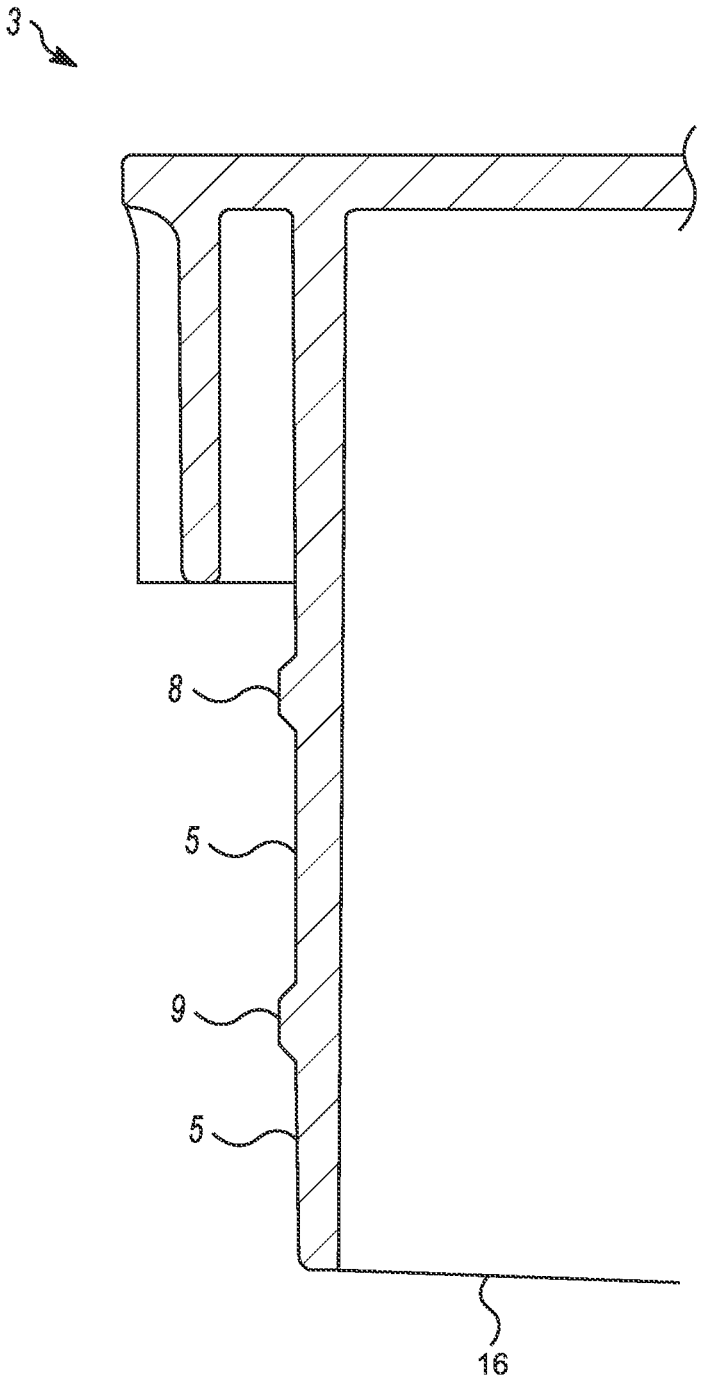
FIG. 11 is a cross-sectional front partial view of an embodiment of the first unit of the dispensing device in accordance with aspects of the present disclosure.

FIG. 11 is a cross-sectional front partial view of an embodiment of the first unit of the dispensing device. In the illustrated embodiment, the protruding seals (8, 9) have a trapezoidal cross-section. In some embodiments, the protruding seals (8, 9) may have any cross-section such that the protruding seals (8,9) are able to bear on the inner cylinder (11). The cross-sectional shapes of the protruding seals can be of various shapes (e.g., trapezoidal, crescent-shaped, square, rectangular, round, etc.). In an embodiment, the one or more protruding seals (8,9) may be located on the inner cylinder (11) and adapted to bear on a portion of the inner cylindrical projection (6).

In an embodiment, the one or more protruding seals (8, 9) can be integrally moulded to the dispensing device such that they cannot be removed. The seals may be a ring, or raised lip or skirt, of material that provide an airtight construction to provide stability to the flowable substance stored inside the flowable substance. The seals may also provide friction to couple the first unit (3) and second unit (4). In an embodiment where the protruding seals (8, 9) are integrally moulded to the dispensing device, the seals (8, 9) may be formed of the same material as the portion of the dispensing device they project from (e.g., the first unit (3)). In some embodiments, the protruding seals (8, 9) may be removable, such as o-rings.

In an embodiment, one or more o-rings are located on the inner cylinder (11) adjacent to the protruding seals and are adapted to bear on the inner cylindrical projection (6) of the dispensing device to provide further friction to couple the first unit (3) and second unit (4), as well as to enhance the oxygen barrier.

Figure 12:
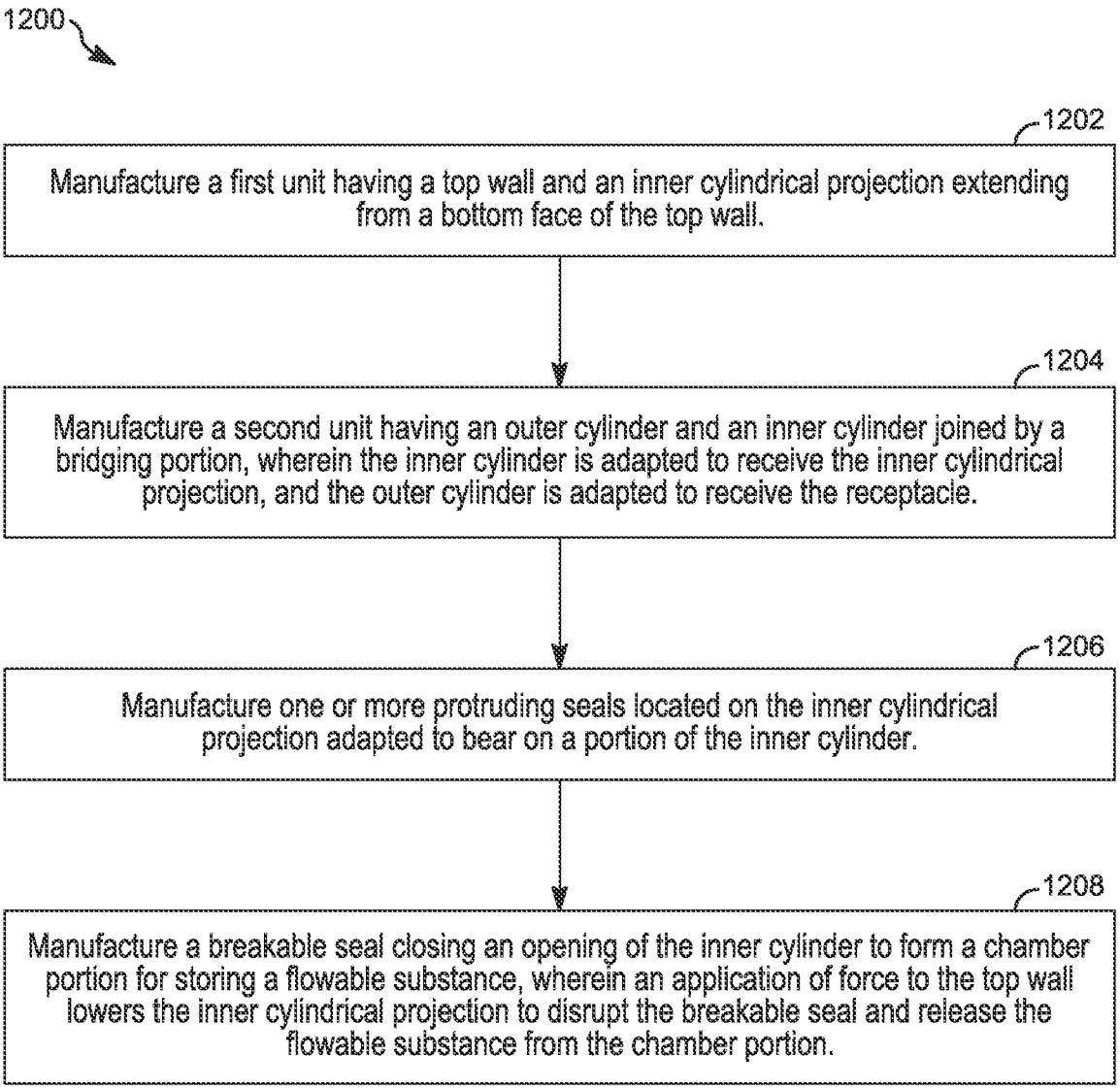
FIG. 12 is a flowchart of example operations of manufacturing the dispensing system in accordance with aspects of the present disclosure.

Referring to FIG. 12, a flowchart of example operations 1200 of a method of manufacturing a dispensing device adapted to be received by a receptacle is shown. An operation 1202 manufactures a first unit having a top wall and an inner cylindrical projection extending from a bottom face of the top wall. An operation 1204 manufactures a second unit having an outer cylinder and an inner cylinder joined by a bridging portion, wherein the inner cylinder is adapted to receive the inner cylindrical projection, and the outer cylinder is adapted to receive the receptacle.

An operation 1206 manufactures one or more protruding seals located on the inner cylindrical projection adapted to bear on a portion of the inner cylinder. In some embodiments, the one or more protruding seals may have a trapezoidal or other shaped-cross section.

An operation 1208 manufactures a breakable seal, which is configured to close an opening of the inner cylinder to form a chamber portion for storing a flowable substance. The flowable substance may be stored in the dispensing device at the time of manufacturing or later during an assembly operation when the first unit and the second unit are assembled together.

In an embodiment, the first unit is formed of polypropylene plastic, the second unit is formed of polypropylene plastic and the breakable seal is formed of low-density polyethylene plastic. In an embodiment, the breakable seal is formed of plastic.

The embodiment operations 1200 may include operations of manufacturing other components of the dispensing systems and devices described herein. For embodiment, a manufacturing operation may include manufacturing an outer cylindrical projection extending from the bottom face of the first unit having a raised collar portion and a collar receiving portion located on the outer cylinder of the second unit adapted to receive the raised collar portion.

In another embodiment, a manufacturing operation may include manufacturing an outer cylindrical projection extending from the bottom face of the first unit having a channel receiving portion with a channel opening, and a channel receiving portion located on the outer cylinder of the second unit, wherein the channel receiving portion of the first unit is adapted to receive the channel of the second unit via the channel opening.

In another embodiment, a manufacturing operation may include manufacturing a receptacle seal projecting from the bridging portion adapted to bear on an inner face of the receptacle. In another embodiment, a manufacturing operation may include manufacturing a pair of o-rings on the inner cylindrical projection, in addition to or in place of the protruding seals. In another embodiment, a manufacturing operation may include manufacturing an outer cylinder of the second unit including a threaded portion adapted to receive a complimentary threaded portion on the receptacle.

In another embodiment, a manufacturing operation may include manufacturing the breakable seal integrally joined to the second unit. In another embodiment, a manufacturing operation may include manufacturing a material of the breakable seal tapered in thickness from a center of the material towards a circumference of the material of the breakable seal. In another embodiment, a manufacturing operation may include manufacturing an affixing means to facilitate a portion of the breakable seal to remain attached to the inner cylinder when disrupted.

In another manufacturing operation, an operation manufactures a receptacle with a threaded portion that is complementary to a threaded portion of the second unit of the dispensing device. In an embodiment, the dispensing device and the receptacle may be formed of other materials, such as aluminium.

Figure 13:
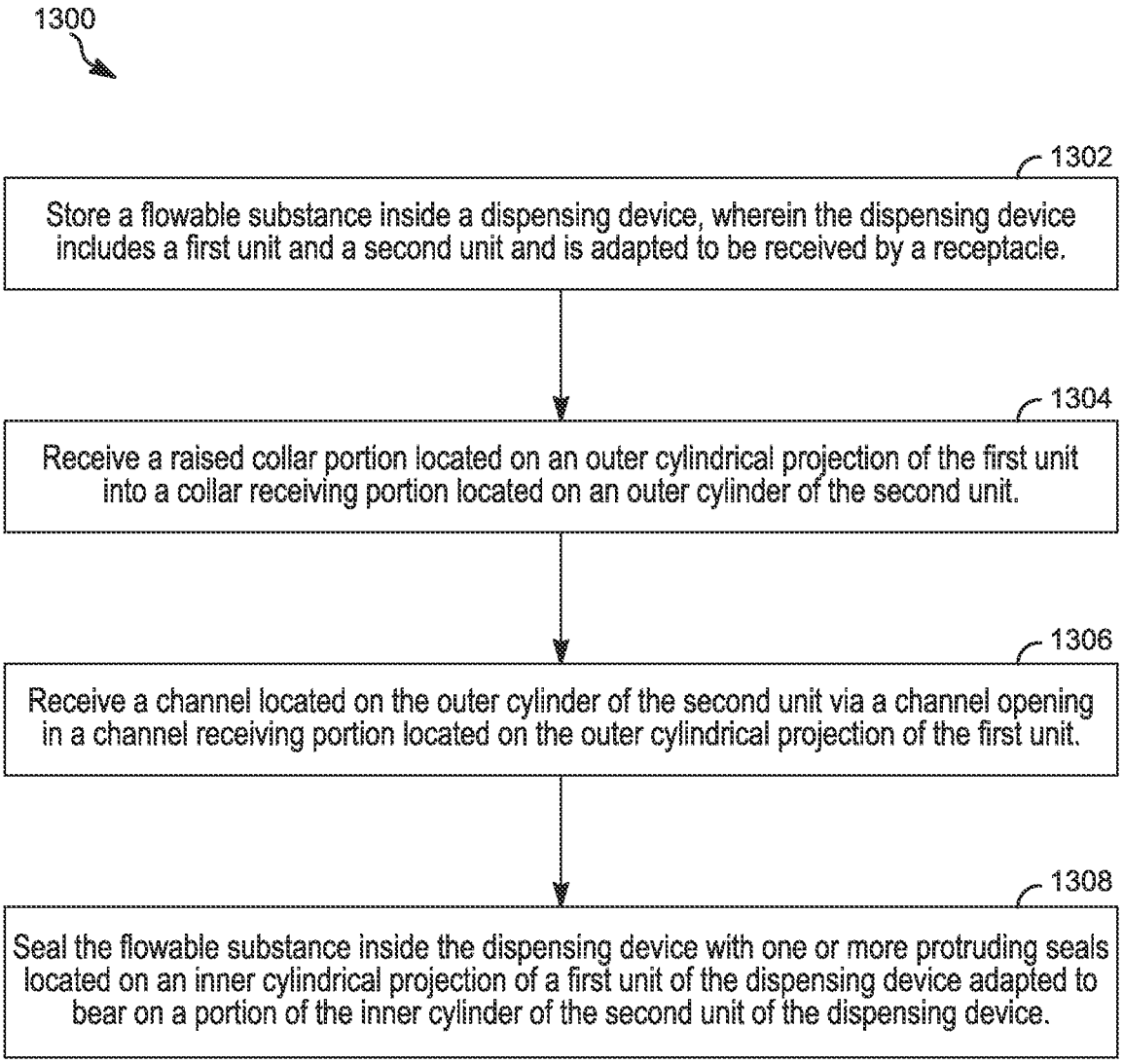
FIG. 13 is a flowchart of examples operations of using a dispensing system in accordance with aspects of the present disclosure.

FIG. 13 is a flowchart of examples operations 1300 of a method of using a dispensing system adapted to be received by a receptacle in accordance with an embodiment of the disclosure. An operation 1302 stores a flowable substance inside a dispensing device, including a first unit and a second unit, and is adapted to be received by a receptacle. In some embodiments, the first unit is turned upside down and the inner cylindrical projection is filled with a flowable substance. The second unit is then placed on top of the first unit and pressed down so that the inner cylindrical projection of the first unit is enclosed by the inner cylinder of the second unit, thereby closing the dispensing device with the flowable substance stored inside.

An operation 1304 receives a raised collar portion located on an outer cylindrical projection of the first unit into a collar receiving portion located on an outer cylinder of the second unit.

An operation 1306 receives a channel located on the outer cylinder of the second unit via a channel opening in a channel receiving portion located on the outer cylindrical projection of the first unit.

An operation 1308 seals the flowable substance inside the dispensing device with one or more protruding seals located on an inner cylindrical projection of a first unit of the dispensing device adapted to bear on a portion of the inner cylinder of the second unit of the dispensing device.

In some embodiments, operations 1302-1308 are performed during assembly operations prior to sale. In other embodiments, operations 1302-1308 may be performed by a user during use.

In other operations, an operation may apply a force to a top wall of the first unit. An operation may urge the raised collar portion out of the collar receiving portion located on the outer cylinder of the second unit. Another operation may guide the channel along the channel receiving portion until bearing on a closed end of the channel receiving portion. An operation may lower the inner cylindrical projection of the first unit to disrupt a breakable seal and an operation may release the flowable substance. In some embodiments where the dispensing device is connected to a receptacle, the flowable substance may release into the receptacle. In other embodiments where the dispensing device is not connected to a receptacle, the flowable substance may release into any desired location (e.g., a glass or plate).

The operations making up the embodiments described herein may be referred to variously as operations, steps, objects, or modules. Furthermore, it should be understood that operations may be performed in any order, adding or omitting operations as desired, unless explicitly claimed otherwise or a specific order is inherently necessitated by the claim language.

In the disclosed embodiments, the dispensing device and dispensing systems can store products for over 12 months. Physical, chemical, biological, and microbiological tests were performed to establish a shelf-life and storage instructions.

EXAMPLES

The purpose of the examples was to model the shelf-life of products (e.g., a flowable substance, such as a powder and water, etc.) that may be stored in the disclosed dispensing systems, including dispensing devices and receptacles. Experimental data was obtained with long-term stability testing and accelerated stability testing. The proposed shelf life of the products was at least 12 months. The products in the examples were samples of a food supplement powder and water. Specifically, a food supplement powder was stored in the dispensing device of the dispensing system and water was stored below the dispensing device in the attached receptacle of the dispensing system. The total weight of finished powder products stored for testing was 57.9 g-64.5 g. The powder product was monitored to detect any changes in total weight.

Organoleptic testing of the products included monitoring the texture, feel smell and colour of the powder to detect any changes. High performance liquid chromatography (HPLC) testing included monitoring the HPLC fingerprint of the powder for any changes. Microbiological testing of the products included monitoring the microbiological load of the powder for any changes. Microbiological testing of the water included monitoring the microbiological load of the water for any changes.

As provided in Table 1 below, the frequency of testing at the long-term stability testing occurred at 0, 6, and 12 months for various samples, and at 0, 6, 9, and 12 months for other samples. The products were subjected to long-term stability testing including storage conditions of temperature:

30° C., humidity: 65% RH. If the samples were stable at the tested time period, a "Y" (meaning "yes") was provided as a confirmation. If a sample was not tested for a particular time period, no value (or letter) was provided in the table.

TABLE 1

| Long Term Stability Test | | | | | |
|---|---|---|---|---|---|
| 30 C./65% RH | Initial | 3 m | 6 m | 9 m | 12 m |
| POWDER | | | | | |
| Total Weight of Finished Good 57.9 g-64.5 g | Y | Y | Y | Y | Y |
| Organoleptic test of powder | Y | Y | Y | Y | Y |
| HPLC Profile of Powder | Y | | Y | | Y |
| Micro of Powder | Y | | Y | | Y |
| Total Aerobic Microbial Count 10,000 cfu/g maximum | Y | | Y | | Y |
| Total Yeasts & Moulds 100 cfu/g maximum | Y | | Y | | Y |
| Bile-tolerant Gram Negative Bacteria 100 PN/g maximum | Y | | Y | | Y |
| Salmonella Not detected/10 g | Y | | Y | | Y |
| *E. coli* Not detected/1 g | Y | | Y | | Y |
| *Staphylococcus Aureus* Not detected/1 g | Y | | Y | | Y |
| WATER | | | | | |
| Micro of Water | | | | | |
| Total Aerobic Microbial Count 10,000 cfu/g maximum | Y | | Y | | Y |
| Total Yeasts & Moulds 100 cfu/g maximum | Y | | Y | | Y |
| Bile-tolerant Gram Negative Bacteria 100 PN/g maximum | Y | | Y | | Y |
| Salmonella Not detected/10 g | Y | | Y | | Y |
| *E. coli* Not detected/1 g | Y | | Y | | Y |
| *Staphylococcus Aureus* Not detected/1 g | Y | | Y | | Y |

As provided in Table 2 below, the frequency of testing at the accelerated stability testing occurred at 0, 6, and 12 months for various samples, and at 0, 6, 9, and 12 months for other samples. The products were subjected to accelerated stability testing including storage conditions of temperature: 40° C., humidity: 75% RH. If the samples were stable at the tested time period, a "Y" (meaning "yes") was provided as a confirmation. If a sample was not tested for a particular time period, no value (or letter) was provided in the table.

TABLE 2

| Accelerated Stability Test | | | | | |
|---|---|---|---|---|---|
| 40 C./75% RH | Initial | 3 m | 6 m | 9 m | 12 m |
| POWDER | | | | | |
| Total Weight of Finished Good 57.9 g-64.5 g | Y | Y | Y | Y | Y |
| Organoleptic test of powder | Y | Y | Y | Y | Y |
| HPLC Profile of Powder | Y | | Y | | Y |
| Micro of Powder | Y | | Y | | Y |
| Total Aerobic Microbial Count 10,000 cfu/g maximum | Y | | Y | | Y |
| Total Yeasts & Moulds 100 cfu/g maximum | Y | | Y | | Y |
| Bile-tolerant Gram Negative Bacteria 100 PN/g maximum | Y | | Y | | Y |
| Salmonella Not detected/10 g | Y | | Y | | Y |
| *E. coli* Not detected/1 g | Y | | Y | | Y |
| *Staphylococcus Aureus* Not detected/1 g | Y | | Y | | Y |
| WATER | | | | | |
| Micro of Water | | | | | |
| Total Aerobic Microbial Count 10,000 cfu/g maximum | Y | | Y | | Y |
| Total Yeasts & Moulds 100 cfu/g maximum | Y | | Y | | Y |
| Bile-tolerant Gram Negative Bacteria 100 PN/g maximum | Y | | Y | | Y |
| Salmonella Not detected/10 g | Y | | Y | | Y |
| *E. coli* Not detected/1 g | Y | | Y | | Y |
| *Staphylococcus Aureus* Not detected/1 g | Y | | Y | | Y |

In summary, in the long-term stability testing and accelerated stability testing described above, both products (the food supplement powder stored in the dispensing device of the dispensing system and the water was stored in the receptacle) were stable for over 12 months in the assembled dispensing system described herein. The preceding description is provided in relation to several embodiments which may share common characteristics and features. It is to be understood that one or more features of any one embodiment may be combinable with one or more features of the other embodiments. In addition, any single feature or combination of features in any of the embodiments may constitute additional embodiments.

In addition, the foregoing describes only some embodiments of the disclosures, and alterations, modifications, additions and/or changes can be made thereto without departing from the scope and spirit of the disclosed embodiments, the embodiments being illustrative and not restrictive.

Furthermore, the disclosures have described in connection with what are presently considered to be the most practical and preferred embodiments, it is to be understood that the disclosure is not to be limited to the disclosed embodiments, but on the contrary, is intended to cover various modifications and equivalent arrangements included within the spirit and scope of the disclosures. Also, the various embodiments described above may be implemented in conjunction with other embodiments, e.g., aspects of one embodiment may be combined with aspects of another embodiment to realize yet other embodiments.

Further, each independent feature or component of any given assembly may constitute an additional embodiment.

The invention claimed is:

1. A dispensing device adapted to be received by a receptacle, comprising:

a first unit having a top wall and an inner cylindrical projection extending from a bottom face of the top wall;

a second unit having an outer cylinder and an inner cylinder joined by a bridging portion, wherein the inner cylinder is adapted to receive the inner cylindrical projection, and the outer cylinder is adapted to receive the receptacle;

breakable seal closing an opening of the inner cylinder to form a chamber portion for storing a flowable substance;

one or more protruding seals located on the inner cylindrical projection adapted to bear on a portion of the inner cylinder; and a coupling mechanism coupling the first unit and the second unit, wherein the coupling mechanism comprises:

an outer cylindrical projection extending from the bottom face of the first unit having a channel receiving portion with a channel opening; and a channel located on the outer cylinder of the second unit, wherein the channel receiving portion of the first unit is adapted to receive the channel of the second unit via the channel opening; and wherein an application of force to the top wall lowers the inner cylindrical projection to disrupt the breakable seal and release the flowable substance.

2. The dispensing device according to claim 1, wherein a second coupling mechanism couples the first and second unit, the second coupling mechanism comprising:

the outer cylindrical projection comprising a raised collar portion; and a collar receiving portion located on the outer cylinder of the second unit adapted to receive the raised collar portion.

3. The dispensing device according to claim 2, wherein the application of force to the top wall of the first unit urges the raised collar portion out of the collar receiving portion and guides the channel along the channel receiving portion until bearing on a closed end of the channel.

4. The dispensing device according to claim 1, wherein the one or more protruding seals have a trapezoidal cross section.

5. The dispensing device according to claim 1, further comprising a receptacle seal projecting from the bridging portion adapted to bear on an inner face of the receptacle.

6. The dispensing device according to claim 5, wherein the bridging portion bears on an upper face of the receptacle and the receptacle seal bears on an inner face of the receptacle perpendicular to the upper face of the receptacle.

7. The dispensing device according to claim 1, further comprising a pair of o-rings on the inner cylindrical projection.

8. The dispensing device according to claim 1, wherein the outer cylinder of the second unit comprises a threaded portion adapted to receive a complimentary threaded portion on the receptacle.

9. The dispensing device according to claim 1, wherein the breakable seal is formed of plastic.

10. The dispensing device according to claim 1, wherein the breakable seal is integrally joined to the second unit.

11. The dispensing device according to claim 1, wherein the material of the breakable seal is tapered in thickness from a center of the breakable seal towards a circumference of the breakable seal.

12. The dispensing device according to claim 1, wherein a portion of the breakable seal remains attached to the inner cylinder when disrupted.

13. The dispensing device according to claim 1, wherein a portion of the breakable seal remains attached to the inner cylinder when disrupted due to an affixing means.

14. The dispensing device according to claim 1, wherein the one or more protruding seals bear on the inner cylinder such that an oxygen barrier is created at the location of the one or more protruding seals bearing on the inner cylinder.

15. The dispensing device according to claim 1, wherein the bridging portion bears on an upper face of the receptacle and a receptacle seal bears on an inner face of the receptacle perpendicular to the upper face of the receptacle such that an oxygen barrier is created at the locations of the bridging portion bearing on an upper face of the receptacle and the receptacle seal bearing on an inner face of the receptacle perpendicular to the upper face of the receptacle.

16. The dispensing device according to claim 1, wherein the flowable substance is a liquid or a solid.

17. The dispensing device according to claim 1, wherein the flowable substance is a vegetable or fruit powder.

18. The dispensing device according to claim 1, wherein the receptacle contains a liquid.

19. The dispensing device according to claim 1, wherein the dispensing device and receptacle are formed of aluminum.

20. The dispensing device according to claim 1, wherein the inner cylindrical projection includes a terminating end that is sloped from one side to the other.

21. The dispensing device according to claim 1, wherein the inner cylindrical projection includes a portion of a terminating end that is shaped.

22. The dispensing device according to claim 1, wherein first unit is formed of polypropylene plastic, the second unit is formed of polypropylene plastic and the breakable seal is formed of low-density polyethylene plastic.

23. A dispensing device adapted to be received by a receptacle, comprising:

a first unit having a top wall and an inner cylindrical projection extending from a bottom face of the top wall;

a second unit having an outer cylinder and an inner cylinder joined by a bridging portion, wherein the inner cylinder is adapted to receive the inner cylindrical projection, and the outer cylinder is adapted to receive the receptacle;

a breakable seal closing an opening of the inner cylinder to form a chamber portion for storing a flowable substance;

one or more protruding seals located on the inner cylinder adapted to bear on a portion of the inner cylindrical projection; and a coupling mechanism coupling the first and second unit, wherein the coupling mechanism comprises:

an outer cylindrical projection extending from the bottom face of the first unit having a channel receiving portion with a channel opening;

a channel located on the outer cylinder of the second unit, wherein the channel receiving portion of the first unit is adapted to receive the channel of the second unit via the channel opening; and wherein an application of force to the top wall lowers the inner cylindrical projection to disrupt the breakable seal and release the flowable substance.

24. A method of manufacturing a dispensing device adapted to be received by a receptacle, comprising:

manufacturing a first unit having a top wall and an inner cylindrical projection extending from a bottom face of the top wall;

manufacturing a second unit having an outer cylinder and an inner cylinder joined by a bridging portion, wherein the inner cylinder is adapted to receive the inner cylindrical projection, and the outer cylinder is adapted to receive the receptacle;

manufacturing one or more protruding seals located on the inner cylindrical projection adapted to bear on a portion of the inner cylinder;

manufacturing a breakable seal closing an opening of the inner cylinder to form a chamber portion for storing a flowable substance, wherein an application of force to the top wall lowers the inner cylindrical projection to disrupt the breakable seal and release the flowable substance from the chamber portion; and manufacturing a coupling mechanism coupling the first and second unit, the coupling mechanism comprises:

an outer cylindrical projection extending from the bottom face of the first unit having a channel receiving portion with a channel opening; and a channel located on the outer cylinder of the second unit, wherein the channel receiving portion of the first unit is adapted to receive the channel of the second unit via the channel opening.

25. A method of using a dispensing system, comprising:

storing a flowable substance inside a dispensing device, wherein the dispensing device includes a first unit and a second unit and is adapted to be received by a receptacle;

receiving a raised collar portion located on an outer cylindrical projection of the first unit into a collar receiving portion located on an outer cylinder of the second unit;

receiving a channel located on the outer cylinder of the second unit via a channel opening in a channel receiving portion located on the outer cylindrical projection of the first unit; and sealing the flowable substance inside the dispensing device with one or more protruding seals located on an inner cylindrical projection of the first unit of the dispensing device adapted to bear on a portion of an inner cylinder of the second unit of the dispensing device.

26. The method according to claim 25, further comprising:

applying force to a top wall of the first unit;

urging the raised collar portion out of the collar receiving portion located on the outer cylinder of the second unit;

guiding the channel along the channel receiving portion until bearing on a closed end of the channel receiving portion;

lowering the inner cylindrical projection of the first unit to disrupt a breakable seal; and releasing the flowable substance.

* * * * *